US007318425B2

(12) United States Patent
Kano et al.

(10) Patent No.: US 7,318,425 B2
(45) Date of Patent: Jan. 15, 2008

(54) FUEL VAPOR TREATMENT APPARATUS

(75) Inventors: Masao Kano, Gamagori (JP); Shinsuke Takakura, Kariya (JP); Tomoaki Nakano, Nagoya (JP); Noriyasu Amano, Gamagori (JP); Shinsuke Kiyomiya, Seto (JP); Yuusaku Nishimura, Toyota (JP)

(73) Assignees: Denso Corporation, Kariya, Aichi-pref. (JP); Nippon Soken, Inc., Nishio, Aichi-pref. (JP); Toyota Jidosha Kabushiki Kaisha, Toyota, Aichi-pref. (JP)

( * ) Notice: Subject to any disclaimer, the term of this patent is extended or adjusted under 35 U.S.C. 154(b) by 82 days.

(21) Appl. No.: 11/398,755

(22) Filed: Apr. 6, 2006

(65) Prior Publication Data

US 2006/0225713 A1 Oct. 12, 2006

(30) Foreign Application Priority Data

Apr. 8, 2005 (JP) ..... 2005-112162
Oct. 4, 2005 (JP) ..... 2005-291437

(51) Int. Cl.
*F02M 33/04* (2006.01)

(52) U.S. Cl. ..... 123/520; 73/118.1

(58) Field of Classification Search ..... 123/516, 123/518–520
See application file for complete search history.

(56) References Cited

U.S. PATENT DOCUMENTS 6,412,277 B2 * 7/2002 Hagen et al. ..... 60/397
6,695,895 B2 * 2/2004 Hyodo et al. ..... 96/111
6,834,535 B2 * 12/2004 Kano et al. ..... 73/49.7
6,971,375 B2 * 12/2005 Amano et al. ..... 123/520
6,993,957 B2 * 2/2006 Kano et al. ..... 73/49.7
7,036,354 B2 * 5/2006 Itakura et al. ..... 73/40
7,107,759 B2 * 9/2006 Annoura et al. ..... 60/283
2005/0022588 A1 * 2/2005 Hayakawa et al. ..... 73/118.1
2006/0144373 A1 7/2006 Kano et al.

FOREIGN PATENT DOCUMENTS

JP 05-018326 1/1993
JP 06-101534 4/1994

OTHER PUBLICATIONS

U.S. Appl. No. 11/522,523, filed Sep. 18, 2006.

* cited by examiner

*Primary Examiner*—Thomas Moulis
(74) *Attorney, Agent, or Firm*—Nixon & Vanderhye P.C.

(57) ABSTRACT

A fuel vapor treatment apparatus includes a first canister, a purge passage, an atmosphere passage, a first detection passage provided with a restrictor, and a passage-changing valve for changing the connection passage of the first detection passage between the purge passage and the atmosphere passage. The apparatus further includes a second canister connecting with the first detection passage on the opposite side of the passage-changing valve across the restrictor. A differential pressure sensor detects a pressure difference between both ends of the restrictor. An ECU computes the concentration of fuel vapor on the basis of the detection result of the differential pressure sensor.

31 Claims, 31 Drawing Sheets

| | | | VALVE 22 | VALVE 19 | VALVE 21 | VALVE 20 | VALVE 18 |
|---|---|---|---|---|---|---|---|
| MAIN PROCESSING | CONCENTRATION MEASUREMENT | S201 ($\Delta P_{Air}$) | OPEN | CLOSE | OPEN | I | CLOSE |
| | | S202 ($P_t$) | OPEN | CLOSE | CLOSE | I | CLOSE |
| | | S203 ($\Delta P_{Gas}$) | OPEN | CLOSE | OPEN | II | CLOSE |
| | PURGE | S302 (1st) | CLOSE | OPEN | OPEN | I | OPEN |
| | | S303 (2nd) | OPEN | CLOSE | OPEN | I | OPEN |
| FIRST CANISTER | | | OPEN | CLOSE | OPEN | I | CLOSE |

I : FIRST STATE
II : SECOND STATE

FIG. 16

| | | | VALVE 22 | VALVE 19 | VALVE 21 | VALVE 110 | VALVE 112 | VALVE 18 |
|---|---|---|---|---|---|---|---|---|
| MAIN PROCESS-ING | CONCENTRA-TION MEASUREMENT | S201 ($\Delta P_{Air}$) | OPEN | CLOSE | OPEN | OPEN | CLOSE | CLOSE |
| | | S202 ($P_t$) | OPEN | CLOSE | CLOSE | OPEN | CLOSE | CLOSE |
| | | S203 ($\Delta P_{Gas}$) | OPEN | CLOSE | OPEN | CLOSE | OPEN | CLOSE |
| | PURGE | S302 (1st) | CLOSE | OPEN | OPEN | OPEN | CLOSE | OPEN |
| | | S303 (2nd) | OPEN | CLOSE | OPEN | OPEN | CLOSE | OPEN |
| FIRST CANISTER | | | OPEN | CLOSE | OPEN | OPEN | CLOSE | CLOSE |

FIG. 18

| | | | VALVE 22 | VALVE 19 | VALVE 110 | VALVE 112 | VALVE 18 |
|---|---|---|---|---|---|---|---|
| MAIN PROCESSING | CONCENTRATION MEASUREMENT | S201 ($\Delta P_{Air}$) | OPEN | CLOSE | OPEN | CLOSE | CLOSE |
| | | S202 ($P_t$) | OPEN | CLOSE | CLOSE | CLOSE | CLOSE |
| | | S203 ($\Delta P_{Gas}$) | OPEN | CLOSE | CLOSE | OPEN | CLOSE |
| | PURGE | S302 (1st) | CLOSE | OPEN | OPEN | CLOSE | OPEN |
| | | S303 (2nd) | OPEN | CLOSE | OPEN | CLOSE | OPEN |
| FIRST CANISTER | | | OPEN | CLOSE | OPEN | CLOSE | CLOSE |

FIG. 20

| | | | VALVE 160 | VALVE 21 | VALVE 20 | VALVE 18 |
|---|---|---|---|---|---|---|
| MAIN PROCESSING | CONCENTRATION MEASUREMENT | S201 ($\Delta P_{Air}$) | I | OPEN | I | CLOSE |
| | | S202 ($P_t$) | I | CLOSE | I | CLOSE |
| | | S203 ($\Delta P_{Gas}$) | I | OPEN | II | CLOSE |
| | PURGE | S302 (1st) | II | OPEN | I | OPEN |
| | | S303 (2nd) | I | OPEN | I | OPEN |
| FIRST CANISTER | | | I | OPEN | I | CLOSE |

I : FIRST STATE
II : SECOND STATE

FIG. 24

| | | | VALVE 160 | VALVE 310 | VALVE 18 |
|---|---|---|---|---|---|
| MAIN PROCESSING | CONCENTRATION MEASUREMENT | S201 ($\Delta P_{Air}$) | I | I | CLOSE |
| | | S202 ($P_t$) | I | III | CLOSE |
| | | S203 ($\Delta P_{Gas}$) | I | II | CLOSE |
| | PURGE | S302 (1st) | II | I | OPEN |
| | | S303 (2nd) | I | I | OPEN |
| FIRST CANISTER | | | I | I | CLOSE |

I : FIRST STATE
II : SECOND STATE
III : THIRD STATE

FIG. 26

| | | | VALVE 22 | VALVE 19 | VALVE 310 | VALVE 18 |
|---|---|---|---|---|---|---|
| MAIN PROCESSING | CONCENTRATION MEASUREMENT | S201 ($\Delta P_{Air}$) | OPEN | CLOSE | I | CLOSE |
| | | S202 ($P_t$) | OPEN | CLOSE | III | CLOSE |
| | | S203 ($\Delta P_{Gas}$) | OPEN | CLOSE | II | CLOSE |
| | PURGE | S302 (1st) | OPEN | OPEN | I | OPEN |
| | | S303 (2nd) | OPEN | CLOSE | I | OPEN |
| FIRST CANISTER | | | OPEN | CLOSE | I | CLOSE |

I : FIRST STATE
II : SECOND STATE
III : THIRD STATE

| | | | VALVE 160 | VALVE 310 | VALVE 18 |
|---|---|---|---|---|---|
| MAIN PROCESSING | CONCENTRATION MEASUREMENT | S201 ($\Delta P_{Air}$) | I | I | CLOSE |
| | | S202 ($P_t$) | I | III | CLOSE |
| | | S203 ($\Delta P_{Gas}$) | I | II | CLOSE |
| | PURGE | S302 (1st) | I | II | OPEN |
| | | S303 (2nd) | I | I | OPEN |
| FIRST CANISTER | | | I | I | CLOSE |

I : FIRST STATE
II : SECOND STATE
III : THIRD STATE

| | | | VALVE 160 | VALVE 310 | VALVE 18 | PUMP |
|---|---|---|---|---|---|---|
| MAIN PROCESSING | CONCENTRATION MEASUREMENT | S201 ($\Delta P_{Air}$) | I | I | CLOSE | II |
| | | S202 ($P_t$) | I | III | CLOSE | II |
| | | S203 ($\Delta P_{Gas}$) | I | II | CLOSE | II |
| | PURGE | S302 (1st) | I | II | OPEN | I |
| | | S303 (2nd) | I | I | OPEN | STOP |
| FIRST CANISTER | | | I | I | CLOSE | STOP |

I : FIRST STATE
II : SECOND STATE
III : THIRD STATE

FIG. 38

| | | | VALVE 22 | VALVE 19 | VALVE 310 | VALVE 18 |
|---|---|---|---|---|---|---|
| MAIN PROCESSING | CONCENTRATION MEASUREMENT | S201 ($\Delta P_{Air}$) | OPEN | CLOSE | I | CLOSE |
| | | S202 ($P_t$) | OPEN | CLOSE | III | CLOSE |
| | | S203 ($\Delta P_{Gas}$) | OPEN | CLOSE | II | CLOSE |
| | PURGE | S302 (1st) | OPEN | CLOSE | II | OPEN |
| | | S303 (2nd) | OPEN | CLOSE | I | OPEN |
| FIRST CANISTER | | | OPEN | CLOSE | I | CLOSE |

I : FIRST STATE
II : SECOND STATE
III : THIRD STATE

FIG. 40

| | | | VALVE 160 | VALVE 610 | VALVE 20 | VALVE 18 |
|---|---|---|---|---|---|---|
| MAIN PROCESSING | CONCENTRATION MEASUREMENT | S201 ($\Delta P_{Air}$) | I | OPEN | I | CLOSE |
| | | S202 ($P_t$) | I | CLOSE | I | CLOSE |
| | | S203 ($\Delta P_{Gas}$) | I | OPEN | II | CLOSE |
| | PURGE | S302 (1st) | I | OPEN | II | OPEN |
| | | S303 (2nd) | I | OPEN | I | OPEN |
| FIRST CANISTER | | | I | OPEN | I | CLOSE |

I : FIRST STATE
II : SECOND STATE

FUEL VAPOR TREATMENT APPARATUS

CROSS-REFERENCE TO RELATED APPLICATION

This application is based on Japanese Patent Applications No. 2005-112162 filed on Apr. 8, 2005, and No. 2005-291437 filed on Oct. 4, 2005, the disclosures of which are incorporated herein by reference.

FIELD OF THE INVENTION

The present invention relates to a fuel vapor treatment apparatus.

BACKGROUND OF THE INVENTION

There has been conventionally known a fuel vapor treatment apparatus that causes a canister to temporarily adsorb fuel vapor produced in a fuel tank and introduces the fuel vapor desorbed from the canister as required into an intake passage of an internal combustion engine to purge the fuel vapor. As one kind of fuel vapor treatment apparatus like this is proposed a fuel vapor treatment apparatus that measures the concentration of fuel vapor in an air-fuel mixture introduced into an intake passage before the fuel vapor is purged and controls an air-fuel ratio in the purged air-fuel mixture with accuracy. In fuel vapor treatment apparatuses disclosed in JP-5-18326A and JP-6-101534A, the flow rate or the density of the air-fuel mixture in a passage for introducing an air-fuel mixture into an intake passage is detected and the flow rate or the density of air in a passage open to the atmosphere is detected and the concentration of fuel vapor is computed from the ratio of these measurement results.

In these fuel vapor treatment apparatuses, negative pressure in the intake passage is applied to respective passages to pass the air-fuel mixture or air through the respective passages and at the same time the flow rate or the density of the air-fuel mixture or air is detected. Therefore, when the negative pressure in the intake passage pulses, the flow rate or the density fluctuates and hence the concentration of fuel vapor computed on the basis of the detection results of such flow rate or density deteriorates in accuracy. Moreover, when the negative pressure in the intake passage is small, the flow rate of the air-fuel mixture or air in each passage decreases and hence detection itself of the flow rate or the density of the air-fuel mixture or air cannot be preformed.

Therefore, the present inventors have earnestly conducted research on a fuel vapor treatment apparatus that reduces pressure in a detection passage having a restrictor by a pump and passes air and an air-fuel mixture through the detection passage and at the same time monitors a change in pressure difference between both ends of the restrictor and computes the concentration of fuel vapor on the basis of the monitoring results. In such a fuel vapor treatment apparatus, because pressure in the detection passage is reduced by the pump, a pressure difference to be detected is made stable except when detection conditions are changed and the flow rate of air or air-fuel mixture can be sufficiently secured in the detection passage. However, the results of research further conducted by the present inventors revealed that it was difficult in the construction of reducing pressure in a detection passage simply by a pump to make a detection gain G (refer to FIG. 45), which is expressed by a difference value between a pressure difference $\Delta P_{Gas}$ when an air-fuel mixture having a vapor concentration of 100% (hereinafter referred to as "100% concentration air-fuel mixture") passed through the restrictor and a pressure difference $\Delta P_{Air}$ when air passed through the restrictor, sufficiently large with respect to the resolution of pressure of a sensor. This results from the following fact: the flow rate of gas at the restrictor is proportional to the square root of the density of the gas and because a difference in density between air and air-fuel mixture is comparatively small, a difference value between pressure differences $\Delta P_{Gas}$ and $\Delta P_{Air}$, which are expressed by intersecting points of pressure difference ($\Delta P$)–flow rate (Q) characteristic curves $C_{Gas}$ of 100% concentration air-fuel mixture and $C_{Air}$ of air at the restrictor and a pressure (P)–flow rate (Q) characteristic curve $C_{Pump}$ of a pump, that is, a detection gain G also becomes small. When a sufficiently large detection gain G cannot be secured like this, the relative detection accuracy of the pressure difference $\Delta P_{Gas}$ to the pressure difference $\Delta P_{Air}$ and by extension the computation accuracy of the concentration of fuel vapor are reduced, which is not preferable.

For the above-mentioned reason, the object of the present invention is to provide a fuel vapor treatment apparatus capable of adjusting the flow rate of purge of fuel vapor with accuracy on the basis of state of the fuel vapor.

SUMMARY OF THE INVENTION

To achieve the above-mentioned object, a vapor fuel processing apparatus of the present invention includes: a first canister for adsorbing fuel vapor produced in a fuel tank; a purge passage for introducing an air-fuel mixture containing fuel vapor desorbed from the first canister into an intake passage; a detection passage for causing the first canister to connect with atmosphere; a gas flow producing means arranged in the detection passage; a second canister interposed between the first canister and the gas flow producing means and for adsorbing fuel vapor flowing from the detection passage; and pressure detecting means provided in the detection passage. The flow rate of purge is adjusted on the basis of pressure detected by the pressure detecting means when the gas flow producing means produces a gas flow. With this construction, the flow rate of purge of the fuel vapor can be adjusted correctly.

BRIEF DESCRIPTION OF THE DRAWINGS

Other objects, feature and advantages of the present invention will become more apparent from the following detailed description made with reference to the accompanying drawings, in which like parts are designated by like reference numerals.

FIG. 16 is a schematic diagram for describing the main operation and a first canister opening operation of the fuel vapor treatment apparatus according to the second embodiment.

FIG. 18 is a schematic diagram for describing the main operation and a first canister opening operation of the fuel vapor treatment apparatus according to the modification of the second embodiment.

FIG. 20 is a schematic diagram for describing the main operation and a first canister opening operation of the fuel vapor treatment apparatus according to the third embodiment.

FIG. 24 is a schematic diagram for describing the main operation and a first canister opening operation of the fuel vapor treatment apparatus according to the sixth embodiment.

FIG. 26 is a schematic diagram for describing the main operation and a first canister opening operation of the fuel vapor treatment apparatus according to the seventh embodiment.

FIG. 38 is a schematic diagram for describing the main operation and a first canister opening operation of the fuel vapor treatment apparatus according to the eleventh embodiment.

FIG. 40 is a schematic diagram for describing the main operation and a first canister opening operation of the fuel vapor treatment apparatus according to the twelfth embodiment.

DETAILED DESCRIPTION OF THE PREFERRED EMBODIMENTS

First Embodiment

Figure 1:
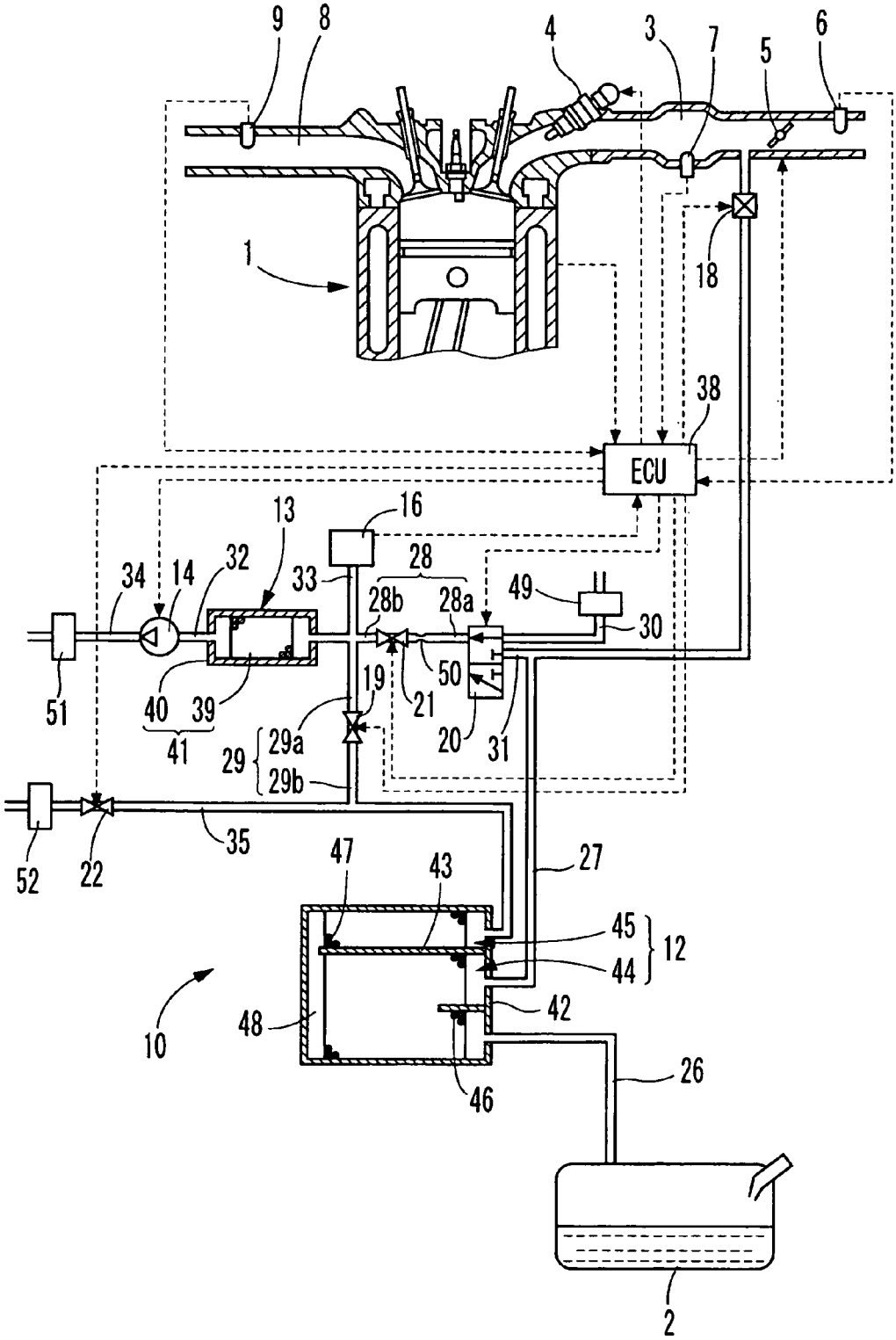
FIG. 1 is a construction diagram showing a fuel vapor treatment apparatus according to a first embodiment.

FIG. 1 shows an example in which a fuel vapor treatment apparatus 10 according to the first embodiment of the present invention is applied to the internal combustion engine 1 of a vehicle (hereinafter referred to as "engine").

The engine 1 is a gasoline engine that develops power by the use of gasoline fuel received in a fuel tank 2. The intake passage 3 of the engine 1 is provided with, for example, a fuel injection device 4 for controlling the quantity of fuel injection, a throttle device 5 for controlling the quantity of intake air, an air flow sensor 6 for detecting the quantity of intake air, an intake pressure sensor 7 for detecting an intake pressure, and the like. Moreover, the discharge passage 8 of the engine 1 is provided with, for example, an air-fuel ratio sensor 9 for detecting an air-fuel ratio.

The fuel vapor treatment apparatus 10 is such that processes fuel vapor produced in the fuel tank 2 and supplies the fuel vapor to the engine 1. The fuel vapor treatment apparatus 10 is provided with a plurality of canisters 12 and 13, a pump 14, a differential pressure sensor 16, a plurality of valves 18 to 22, a plurality of passages 26 to 35, and an electronic control unit (ECU) 38.

In the first canister 12, a case 42 is partitioned by a partition wall 43 to form two adsorption parts 44, 45. The respective adsorption parts 44, 45 are packed with adsorptive agents 46, 47 made of activated carbon or the like. The main adsorption part 44 is provided with an introduction passage 26 connecting with the inside of the fuel tank 2. Hence, fuel vapor produced in the fuel tank 2 flows into the main adsorption part 44 through the introduction passage 26 and is adsorbed by the adsorptive agent 46 in the main adsorption part 44 in such a way as to be desorbed. The main adsorption part 44 is further provided with a purge passage 27 connecting with the intake passage 3. Here, a purge-controlling valve 18 made of an electromagnetically driven two-way valve is provided at the end of the intake passage side of the purge passage 27. The purge-controlling valve 18 is opened or closed to control the connection between the purge passage 27 and the intake passage 3. With this, in a state where the purge controlling valve 18 is opened, negative pressure developed on the downstream side of the throttle device 5 of the intake passage 3 is applied to the main adsorption part 44 through the purge passage 27. Therefore, when the negative pressure is applied to the main adsorption part 44, fuel vapor is desorbed from the adsorptive agent 46 in the main adsorption part 44 and the desorbed fuel vapor is mixed with air and is introduced into the purge passage 27, whereby fuel vapor in the air-fuel mixture is purged to the intake passage 3. In this regard, the fuel vapor purged into the intake passage 3 through the purge passage 27 is combusted in the engine 1 along with fuel injected from the fuel injection device 4.

The main adsorption part 44 connects with a subordinate adsorption part 45 via a space 48 at the inside bottom of the case 42. A transit passage 29 connecting with the middle portion of a first detection passage 28 connects with the subordinate adsorption part 45. A connection-controlling valve 19 made of an electromagnetically driven two-way valve is provided in the middle portion of the transit passage 29. The connection controlling valve 19 is opened or closed to control the connection between a portion 29*a* closer to the first detection passage 28 than the connection controlling valve 19 of the transit passage 29 and a portion 29*b* closer to the subordinate adsorption part 45 than the connection controlling valve 19. With this, in a state where the connection controlling valve 19 and the purge controlling valve 18 are opened, negative pressure in the intake passage 3 is applied to the subordinate adsorption part 45 through the purge passage 27, the main adsorption part 44, and the space 48 and also to the transit passage 29 and the first detection passage 28. Therefore, when the negative pressure is applied to the subordinate adsorption part 45 in a state where an air-fuel mixture exists in the first detection passage 28, the air-fuel mixture in the first detection passage 28 flows into the subordinate adsorption part 45 through the transit passage 29, whereby fuel vapor in the air-fuel mixture is adsorbed by the adsorptive agent 47 in the subordinate adsorption part 45 in such a way as to be desorbed. Moreover, when the negative pressure is applied to the subordinate adsorption part 45, the fuel vapor is desorbed from the adsorptive agent 47 in the subordinate adsorption part 45 and the desorbed fuel vapor remains once in the space 48 and then is adsorbed by the adsorptive agent 46 in the main adsorption part 44.

A passage-changing valve 20 is constructed of an electromagnetically driven three-way valve that performs a two-position action. The passage-changing valve 20 is connected to a first atmosphere passage 30 open to the atmosphere via a filter 49. Moreover, the passage changing valve 20 is connected to a branch passage 31 branched from the purge passage 27 between the main adsorption part 44 and the purge controlling valve 18. Further, the passage-changing valve 20 is connected to one end of the first detection passage 28. The passage-changing valve 20 connected in this manner changes a passage connecting with the first detection passage 28 between the first atmosphere passage 30 and the branch passage 31 of the purge passage 27. Therefore, in a first state where the first atmosphere passage 30 connects with the first detection passage 28, air can flow into the first detection passage 28 through the first atmosphere passage 30. Moreover, in a second state where the branch passage 31 connects with the first detection passage 28, the air-fuel mixture containing the fuel vapor in the purge passage 27 can flow into the first detection passage 28 through the branch passage 31.

The pump 14 is constructed of, for example, an electrically driven vane pump. The suction port of the pump 14 connects with one end of a second detection passage 32 and the discharge port of the pump 14 connects with a second atmosphere passage 34 open to the atmosphere via a filter 51. The pump 14 is so constructed as to reduce pressure in the second detection passage 32 by its action and discharges gas sucked from the second detection passage 32 to the second atmosphere passage 34 at the time of reducing the pressure.

A second canister 13 has an adsorption part 41 of a case 40 packed with an adsorptive agent 39 made of activated carbon or the like. The adsorption part 41 has the end opposite to the passage-changing valve 20 across the restrictor 50 of the first detection passage 28 and the end opposite to the pump 14 of the second detection passage 32 connected thereto at two positions across the adsorptive agent 39. Hence, when the pump 14 is operated in a state where the air-fuel mixture exists in the first detection passage 28, the air-fuel mixture in the first detection passage 28 flows into the adsorption part 41 and fuel vapor in the air-fuel mixture is adsorbed by the adsorptive agent 39 in the adsorption part 41 in such a way to be desorbed. Here, at this time, in this embodiment, the capacity of the adsorptive agent 39 is set in such a way as to prevent the fuel vapor adsorbed by the adsorptive agent 39 from being desorbed. When negative pressure in the intake passage 3 is applied to the first detection passage 28, air flows from the second atmosphere passage 34 to the pump 14, whereby the fuel vapor is desorbed from the adsorptive agent 39. In this embodiment, two portions 29*a* and 29*b* across the connection-controlling valve 19 connect with each other in the transit passage 29 and hence the negative pressure in the intake passage 3 is applied to the first detection passage 28. Therefore, the fuel vapor desorbed from the adsorptive agent 39 flows into the subordinate adsorption part 45 through the transit passage 29 and is adsorbed by the adsorptive agent 47.

A restrictor 50 for restricting the passage area of the first detection passage 28 is formed in the middle portion between the connection portion of the transit passage 29 and the passage-changing valve 20 in the first detection passage 28. Moreover, a passage opening/closing valve 21 made of an electromagnetically driven two-way valve is provided in the middle portion between the connection portion of the transit passage 29 and the restrictor 50 in the first detection passage 28. The passage opening/closing valve 21 is opened or closed to control the connection between a portion 28*a* closer to the passage-changing valve 20 than the valve 21 of the first detection passage 28 and a portion 28*b* closer to the second canister 13 than the valve 21. Here, when the portion 28*a* does not connect with the portion 28*b*, the first detection passage 28 is brought into a closed state between the passage changing valve 20 connecting with the passages 30, 31 and the second canister 13, whereas when the portions 28*a* connects with the portion 28*b*, the first detection passage 28 is brought into an open state. That is, the passage opening/closing valve 21 opens or closes the first detection passage 28 in a portion closer to the second canister 13 than the passages 30, 31, to be more specific, between the second canister 13 and the restrictor 50.

The differential pressure sensor 16 connects with a pressure introducing passage 33 branched from the first detection passage 28 between the second canister 13 and the passage opening/closing valve 21. With this, the differential pressure sensor 16 detects a pressure difference between pressure that it receives through the pressure introducing passage 33 from a portion closer to the second canister 13 than the restrictor 50 of the first detection passage 28 and the atmospheric pressure. Therefore, a pressure difference detected by the differential pressure sensor 16 when the pump 14 is operated is substantially equal to the pressure difference between both ends of the restrictor 50 in a state where the passage opening/closing valve 21 is opened. Moreover, in a state where the passage opening/closing valve 21 is closed, the first detection passage 28 is closed on the suction side of the pump 14 and hence a pressure difference detected by the differential pressure sensor 16 when the pump 14 is operated is substantially equal to the shutoff pressure of the pump 14.

A canister closing valve 22 is constructed of an electromagnetically driven two-way valve and is provided in the middle portion in a third atmosphere passage 35 branched from the transit passage 29 between the connection controlling valve 19 and the subordinate adsorption part 45. An end opposite to the transit passage 29 across the canister-closing valve 22 of the third atmosphere passage 35 is open to the atmosphere via a filter 52. Therefore, in a state where the canister-closing valve 22 is opened, the subordinate adsorption part 45 is open to the atmosphere through the third atmosphere passage 35 and the transit passage 29.

The ECU 38 is mainly constructed of a microcomputer having a CPU and a memory and is electrically connected to the pump 14, the differential pressure sensor 16, and the valves 18 to 22 of the fuel vapor treatment apparatus 10 and the respective elements 4 to 7 and 9 of the engine 1. The ECU 38 controls the respective operations of the pump 14 and the valves 18 to 22 on the basis of the detection results of the respective sensors 16, 6, 7, 9, the temperature of cooling water of the engine 1, the temperature of working oil of the vehicle, the number of revolutions of the engine 1, the accelerator position of the vehicle, the ON/OFF state of an ignition switch, and the like. Moreover, the ECU 38 of this embodiment has also the functions of controlling the engine 1, such as the quantity of fuel injection of the fuel injection device 4, the opening of the throttle device 5, the ignition timing of the engine 1, and the like.

Figure 3:
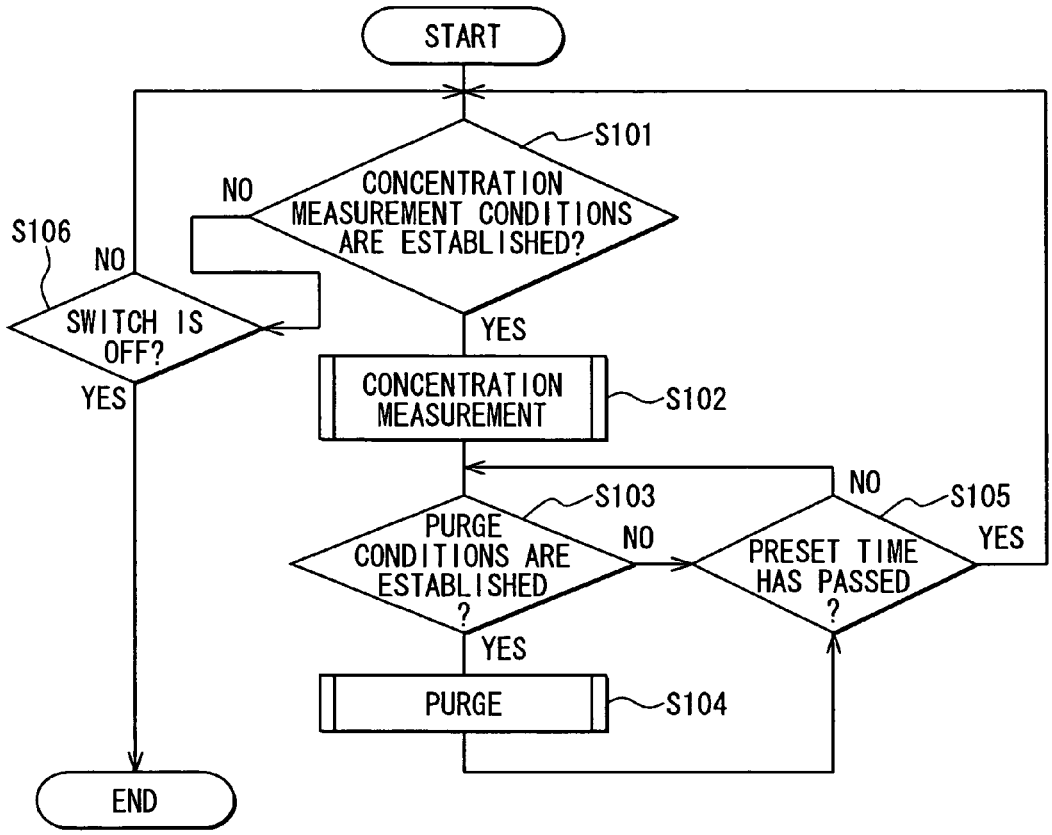
FIG. 3 is a flow chart for describing the main operation of the fuel vapor treatment apparatus according to the first embodiment.

Next, the flow of a main operation characteristic of the fuel vapor treatment apparatus 10 will be described on the basis of FIG. 3. The main operation is started when an ignition switch is turned on to start the engine 1.

First, in step S101, it is determined by the ECU 38 whether or not concentration measurement conditions are satisfied. Here, the satisfaction of the concentration measurement conditions means that the physical quantities expressing the state of the vehicle (hereinafter referred to as "vehicle state quantities"), for example, the temperature of cooling water of the engine 1, the temperature of working oil of the vehicle, the number of revolutions of the engine 1 are within specified ranges. Such concentration measurement conditions are previously set such that they are satisfied just after the engine 1 is started and are stored in the memory of the ECU 38.

When it is determined that step S101 is affirmative, the routine proceeds to step S102 where concentration measurement processing is carried out. When the concentration of fuel vapor in the purge passage 27 is measured by this concentration measurement processing in a state where the purge controlling valve 18 is closed, the routine proceeds to step S103 where it is determined by the ECU 38 whether or not purge conditions are satisfied. Here, the satisfaction of the purge conditions means that the vehicle state quantities, for example, the temperature of cooling water of the engine 1, the temperature of working oil of the vehicle, the number of revolutions of the engine are within specified ranges different from those of the above-mentioned concentration measurement conditions. Such purge conditions are previously set such that they are satisfied, for example, when the temperature of cooling water of the engine 1 becomes a specified value or higher and hence the warm-up of the engine 1 is completed and are stored in the memory of the ECU 38.

When it is determined that step S103 is affirmative, the routine proceeds to step S104 where purge processing is carried out. When fuel vapor is purged by this purge processing from the purge passage 27 into the intake passage 3 in a state where the purge controlling valve 18 is opened and purge stop conditions are satisfied, the routine proceeds to step S105. Here, the satisfaction of the purge stop conditions means that the vehicle state quantities, for example, the number of revolutions of the engine 1 and acceleration position are within specified ranges different from those of the above-mentioned concentration measurement conditions and the above-mentioned purge conditions. Such purge stop conditions are previously set such that they are satisfied, for example, when the acceleration position is made a specified value or smaller to decrease the speed of the vehicle, and are stored in the memory of the ECU 38.

Moreover, when it is determined that step S101 is negative, the routine proceeds directly to step S105.

In step S105, it is determined by the ECU 38 whether or not a set time elapses from the time when the concentration measurement processing in step S102 is finished. When it is determined that this step S105 is affirmative, the routine returns to step S101, whereas when it is determined that this step S105 is negative, the routine returns to step S103. Here, the above-mentioned set time to become the determination criterion in step S105 is previously set in consideration of secular changes in the concentration of fuel vapor and the required accuracy of the concentration and is stored in the memory of the ECU 38.

While following processing steps S102 to S105 when it is determined that step S101 is affirmative has been described, following processing step S106 when it is determined that step S101 is negative will be described.

Figure 5:
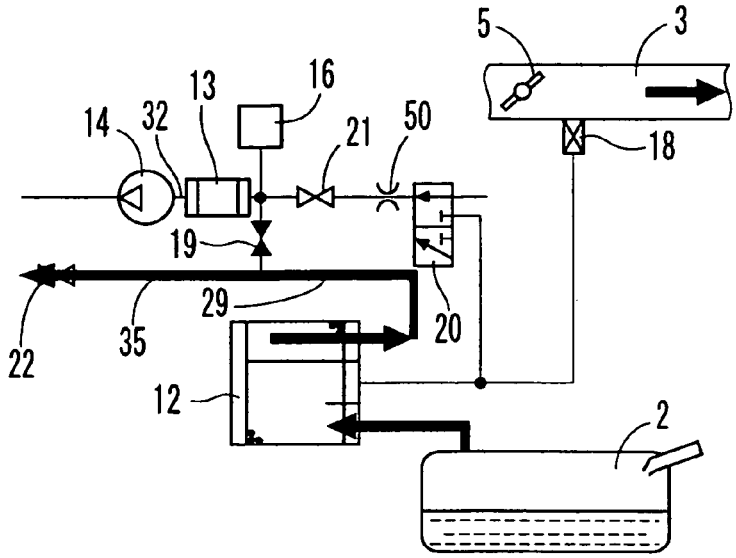
FIG. 5 is a schematic diagram for describing the first canister opening operation of the fuel vapor treatment apparatus according to the first embodiment.

In step S106, it is determined by the ECU 38 whether or not the ignition switch is turned off. When it is determined that this step S106 is negative, the routine returns to step S101. Meanwhile, when it is determined that this step S106 is affirmative, the main operation is finished. In the fuel vapor treatment apparatus 10, after the main operation is finished, a first canister opening operation that brings the respective valves 18 to 22 to the states shown in FIG. 4 to open the canister 12 to the atmosphere as shown in FIG. 5 is carried out.

Here, the above-mentioned concentration measurement processing in step S102 will be described in more detail.

Figure 6:
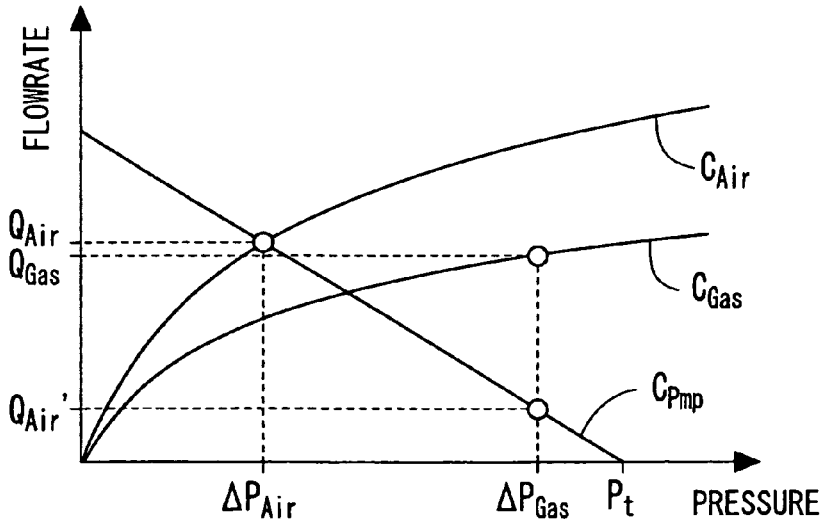
FIG. 6 is a characteristic graph for describing concentration measurement processing in FIG. 3.

First, the measurement principle of the concentration of fuel vapor in the fuel vapor treatment apparatus 10 will be described. For example, in the case of the pump 14 having internal leak such as a vane pump, the quantity of internal leak varies according to load and hence, as shown in FIG. 6, the pressure (P)—flow rate (Q) characteristic curve $C_{pmp}$ of the pump 14 is expressed by the following first-degree equation (1). Here, in the equation (1), K1 and K2 are constants specific to the pump 14.

$$Q=K1\times P+K2 \quad (1)$$

Here, assuming that the shutoff pressure of the pump 14 is $P_t$, when the suction side of the pump 14 is shut off, that is, $P=P_t$, $Q=0$ and hence the following equation (2) is obtained.

$$K2=-K1\times P_t \quad (2)$$

In the fuel vapor treatment apparatus 10, the pressure loss of flowing gas is reduced to as small a quantity as can be neglected on a side closer to the second canister 13 than the restrictor 50 of the first detection passage 28, the second canister 13, and the second detection passage 32. With this, in a state where the passage opening/closing valve 21 is opened, the pressure P of the pump 14 is thought to be substantially equal to a pressure difference ΔP between both ends of the restrictor 50 (hereinafter simply referred to as "pressure difference"). Here, it is also possible to perform the following processing: when the pressure loss of flowing gas cannot be neglected in the second canister 13 and in the second detection passage 32, the pressure loss is previously stored in the ECU 38 and ΔP is corrected as required.

Moreover, when air passes through the restrictor 50 in a state where the passage opening/closing valve 21 is opened, the second canister 13 passes the air to the pump 14 and hence the flow rate of passage of air $Q_{Air}$ is substantially equal to the flow rate Q of suction of air of the pump 14. Therefore, the flow rate $Q_{Air}$ and the pressure difference $\Delta P_{Air}$ when air passes through the restrictor 50 satisfy the following relationship equation (3) obtained from the equations (1), (2).

$$Q_{Air}=K1\times(\Delta P_{Air}-P_t) \quad (3)$$

Meanwhile, when the air-fuel mixture containing fuel vapor (hereinafter simply referred to as "air-fuel mixture") passes through the restrictor 50 in a state where the passage opening/closing valve 21 is open, the second canister 13 passes only air and hence the flow rate of passage of air $Q_{Air}'$ in the air-fuel mixture is substantially equal to the flow rate of suction of air Q of the pump 14. Therefore, the flow rate of passage of air $Q_{Air}'$ in the air-fuel mixture and the pressure difference $\Delta P_{Gas}$ when the air-fuel mixture passes through the restrictor 50 satisfy the relationship of the following equation (4) obtained by the equations (1) and (2).

$$Q_{Air}'=K1\times(\Delta P_{Gas}-P_t) \quad (4)$$

Here, when it is assumed that the flow rate of passage of the whole air-mixture at the restrictor 50 is $Q_{Gas}$ and the concentration of fuel vapor is D (%), the flow rate of passage of $Q_{Air}'$ in the air-fuel mixture satisfies the following equation (5). Hence, the following equation (6) can be obtained from this equation (5).

$$Q_{Air}'=Q_{Gas}\times(1-D/100) \quad (5)$$

$$D=100\times(1-Q_{Air}'/Q_{Gas}) \quad (6)$$

The pressure difference ΔP–flow rate Q characteristic curve of gas at the restrictor 50 is expressed by the following equation (7) using the density ρ of the gas passing through the restrictor 50. Here, K3 in the equation (7) is a constant specific to the restrictor 50 and is a value expressed by the following equation (8) when the diameter and the flow coefficient of the restrictor 50 are assumed to be d and α, respectively.

$$Q=K3\times(\Delta P/\rho)^{1/2} \quad (7)$$

$$K3=\alpha\times\pi\times d^2/4\times 2^{1/2} \quad (8)$$

Therefore, the ΔP–Q characteristic curve $C_{Air}$ shown in FIG. 6 is expressed by the following equation (9) using the density $\rho_{Air}$ of air.

$$Q_{Air}=K3\times(\Delta P_{Air}/\rho_{Air})^{1/2} \quad (9)$$

Moreover, the ΔP–Q characteristic curve $C_{Gas}$ of the air-fuel mixture shown in FIG. 6 is expressed by the following equation (10) by the use of the density $\rho_{Gas}$ of the air-fuel mixture. Here, when it is assumed that the density of hydrocarbon (HC) of a component of the fuel vapor is $\rho_{HC}$, there is a relationship expressed by the following relationship equation (11) between the density $\rho_{Gas}$ of the air-fuel mixture and the concentration D (%) of fuel vapor in the air-fuel mixture.

$$Q_{Gas}=K3\times(\Delta P_{Gas}/\rho_{Gas})^{1/2} \quad (10)$$

$$D=100\times(\rho_{Air}-\rho_{Gas})/(\rho_{Air}-\rho_{HC}) \quad (11)$$

From the above-mentioned equations, by eliminating K1 from the equations (3) and (4), the following equation (12) is obtained. Moreover, by eliminating K3 from the equations (9) and (10), the following equation (13) is obtained.

$$Q_{Air}/Q_{Air}'=(\Delta P_{Air}-P_t)/(\Delta P_{Gas}-P_t) \quad (12)$$

$$Q_{Air}/Q_{Gas}=\{(\Delta P_{Air}/\Delta P_{Gas})\times(\rho_{Gas}/\rho_{Air})\}^{1/2} \quad (13)$$

Furthermore, by eliminating $Q_{Air}$ from the equations (12) and (13), the following equation (14) is obtained, and the following equation (15) is obtained from the equation (11). Hence, the following equation (16) is obtained from these equations (14), (15), and (6). P1, P2, and ρ in the equation (16) are expressed by the following equations (17), (18), and (19).

$$Q_{Air}'/Q_{Gas}=(\Delta P_{Gas}-P_t)/(\Delta P_{Air}-P_t)\times\{(\Delta P_{Air}/\Delta P_{Gas})\times(\rho_{Gas}/\rho_{Air})\}^{1/2} \quad (14)$$

$$\rho_{Gas}=\rho_{Air}-(\rho_{Air}-\rho_{HC})\times D/100 \quad (15)$$

$$D=100\times[1-P1\times\{P2\times(1-\rho\times D\}^{1/2}] \quad (16)$$

$$P1=(\Delta P_{Gas}-P_t)/(\Delta P_{Air}-P_t) \quad (17)$$

$$P2=\Delta P_{Air}/\Delta P_{Gas} \quad (18)$$

$$\rho=(\rho_{Air}-\rho_{HC})/(100\times\rho_{Air}) \quad (19)$$

When both sides of the equation (16) are squared and rearranged for D, the following quadratic equation (20) is obtained. When this quadratic equation (20) is solved for D, the following solution (21) is obtained. Here, M1 and M2 in the solution (21) are expressed by the following equations (22) and (23).

$$D^2+100\times(100\times P1^2\times P2\times\rho-2)\times D+100^2\times(1-P1^2\times P2) \quad (20)$$

$$D=50\times\{-M1\pm(M1^2-4\times M2)^{1/2}\} \quad (21)$$

$$M1=100\times P1^2\times P2\times\rho-2 \quad (22)$$

$$M2=1-P1^2\times P2 \quad (23)$$

Therefore, because a value beyond a range from 0 to 100 of the solutions (21) of the quadratic equation (20) does not hold as the concentration D of fuel vapor, a value within the range from 0 to 100 of the solutions (21) is obtained as the equation (24) of computing the concentration D of fuel vapor.

$$D=50\times\{-M1-(M1^2-4\times M2)^{1/2}\} \quad (24)$$

Figure 7:
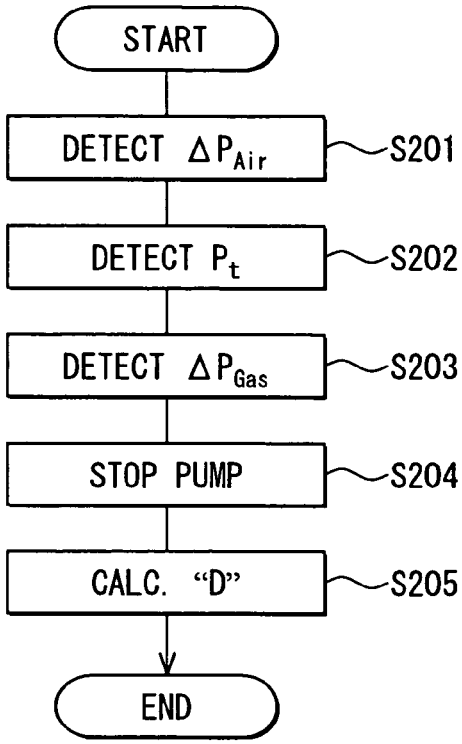
FIG. 7 is a flow chart for describing the concentration measurement processing in FIG. 3.

In the equation (24) of computing the concentration D of fuel vapor obtained in this manner, among variables included in M1 and M2, $\rho_{Air}$ and $\rho_{HC}$ are values determined as physical constants and are stored as parts of the equation (24) in the memory of the ECU 38 in this embodiment. Therefore, to compute the concentration D of fuel vapor by the use of the equation (24), among variables included in M1 and M2, the pressure differences $\Delta P_{Air}$, $\Delta P_{Gas}$ when air and air-fuel mixture pass through the restrictor 50 and the shutoff pressure $P_t$ of the pump 14 are necessary. Hence, in the above-mentioned concentration measurement processing in the step S102, the pressure differences $\Delta P_{Air}$, $\Delta P_{Gas}$ and the shutoff pressure $P_t$ are detected and the concentration D of fuel vapor is computed from these detected values. Hereinafter, the flow of the concentration measurement processing will be described on the basis of FIG. 7. In this regard, it is assumed that when the concentration measurement processing is carried out, the purge controlling valve 18 and the connection controlling valve 19 are in a closed state, the passage changing valve 20 is in the first state, and the passage opening/closing valve 21 and the canister closing valve 22 are in the open state.

Figures 2, 4:
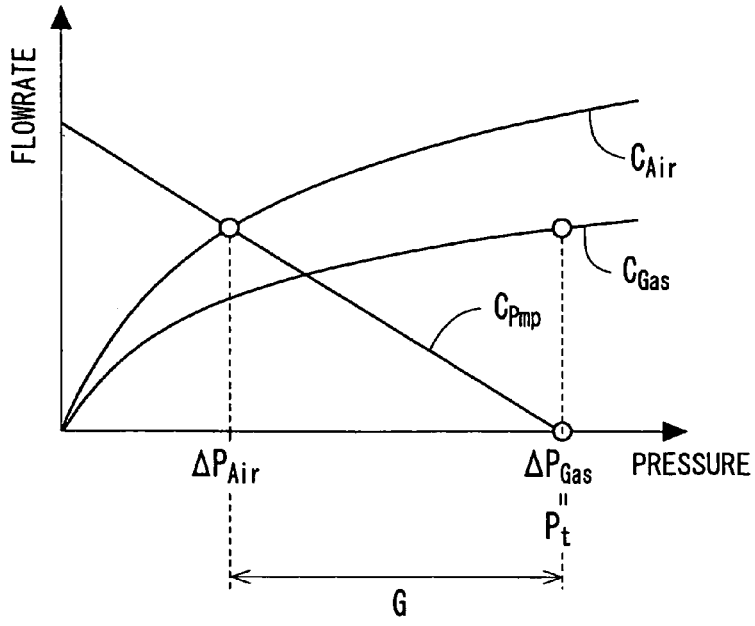
FIG. 2 is a characteristic graph for describing the principle of the present invention.
FIG. 4 is a schematic diagram for describing the main operation and a first canister opening operation of the fuel vapor treatment apparatus according to the first embodiment.
Figure 8:
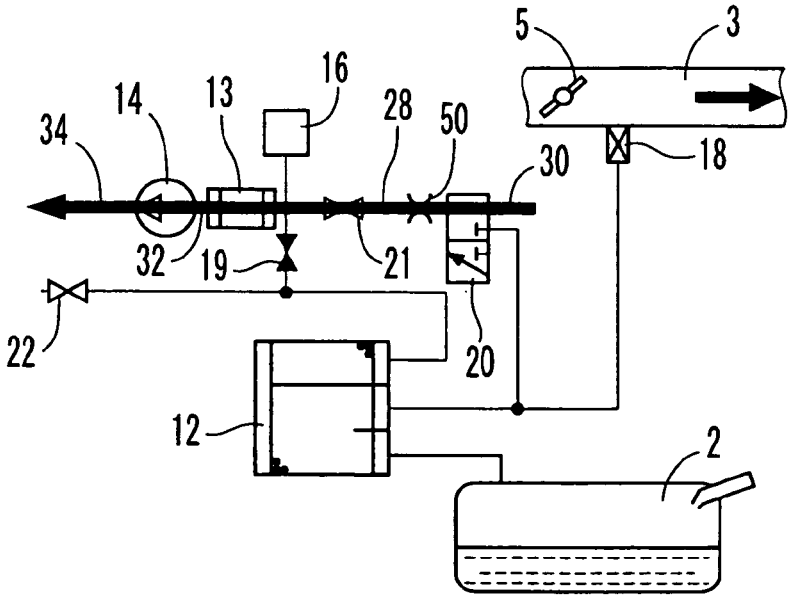
FIG. 8 is a schematic diagram for describing the concentration measurement processing in FIG. 3.
Figure 9:
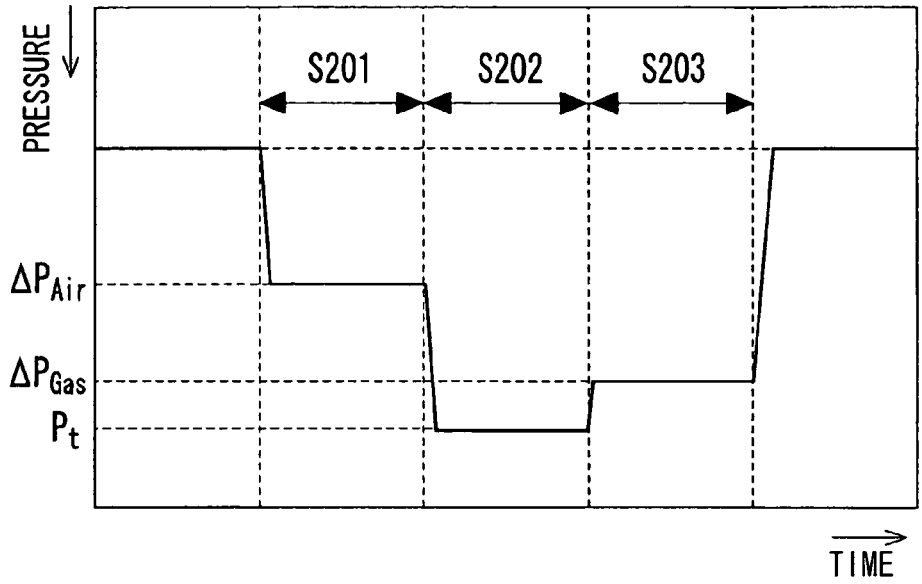
FIG. 9 is a characteristic graph for describing the concentration measurement processing in FIG. 3.
Figure 10:
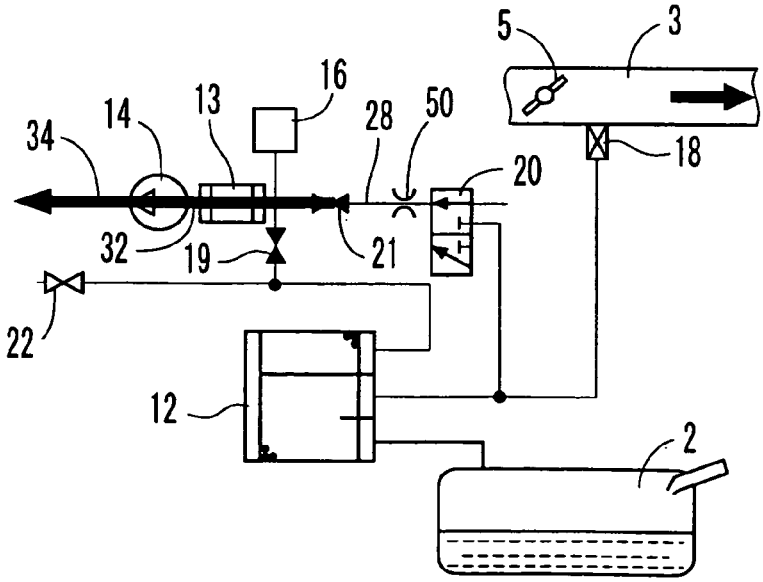
FIG. 10 is a schematic diagram for describing the concentration measurement processing in FIG. 3.

First, in step S201, the pump 14 is driven and controlled to a specified number of revolutions by the ECU 38 to reduce pressure in the second detection passage 32. At this time, the respective valves 18 to 22 are in the same states as the states when the concentration measurement processing is started, as shown in FIG. 4. Hence, as shown in FIG. 8, air flows from the first atmosphere passage 30 into the first detection passage 28 and hence the pressure difference detected by the differential pressure sensor 16 is changed to a specified value $\Delta P_{Air}$ as shown in FIG. 9. Then, in this step S201, when the pressure difference detected by the differential pressure sensor 16 becomes stable, the stable value is stored as the pressure difference $\Delta P_{Air}$ when air passes in the memory of the ECU 38. Here, in this step S201, air discharged from the pump 14 to the second discharge passage 34 is dissipated into the atmosphere through the filter 51.

Next, in step S202, while the pump 14 is being driven and controlled to the specified number of revolutions just as with step S201, the passage opening/closing valve 21 is brought to a closed state. With this, the respective valves 18 to 22 are brought into the states shown in FIG. 4 and hence the first detection passage 28 is closed as shown in FIG. 9 and the pressure difference detected by the differential pressure sensor 16 is changed to the shutoff pressure $P_t$ of the pump 14 as shown in FIG. 9. Then, in this step S202, when the pressure difference detected by the differential pressure sensor 16 becomes stable, the stable value is stored as the shutoff pressure $P_t$ of the pump 14 in the memory of the ECU 38. In this regard, in this step S202, air discharged from the pump 14 to the second atmosphere passage 34 by the time when the pressure difference detected by the differential pressure sensor 16 becomes stable is dissipated into the atmosphere through the filter 51.

Figure 11:
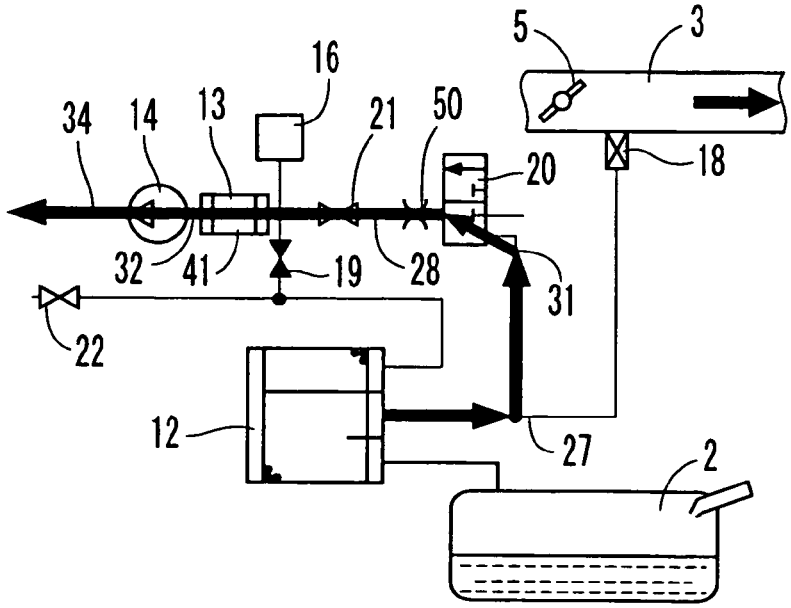
FIG. 11 is a schematic diagram for describing the concentration measurement processing in FIG. 3.

Successively, in step S203, while the pump 14 is being controlled to the specified number of revolutions just as with step S201, the passage changing valve 20 is brought into the second state and at the same time the passage opening/closing valve 21 is bought into an open state. With this, the respective valves 18 to 22 are brought into the states shown in FIG. 4 and hence, as shown in FIG. 11, the air-fuel mixture flows from the branch passage 31 of the purge passage 27 into the first detection passage 28, and the pressure difference detected by the differential pressure sensor 16, as shown in FIG. 9, is changed to a value $\Delta P_{Gas}$ relating to the concentration D of fuel vapor. Hence, in this step S203, when the pressure difference detected by the differential pressure sensor 16 becomes stable, the stable value is stored as the pressure difference $\Delta P_{Gas}$ when the air-fuel mixture passes in the memory of the ECU 38. In this step S203, the fuel vapor in the air-fuel mixture passing through the restrictor 50 does not pass to the second detection passage 32 but is adsorbed by the adsorption part 41. Hence, only air passing through the second canister 13 of the air-fuel mixture reaches the pump 14. Therefore, only air is discharged from the pump 14 and is dissipated into the atmosphere.

In step S204 following step 203, the pump 14 is stopped by the ECU 38. Further, in step S204 in this embodiment, the passage-changing valve 20 is returned to the first state.

Thereafter, in step S205, the pressure differences $\Delta P_{Air}$ and $\Delta P_{Gas}$ stored in steps S201 and S203, the shutoff pressure $P_t$ stored in step S202, and the previously stored equation (24) are read from the memory of the ECU 38 to the CPU. Further, in step S205, the pressure differences $\Delta P_{Air}$, $\Delta P_{Gas}$ and the shutoff pressure $P_t$, which are read, are substituted into the equation (24) to compute the concentration D of fuel vapor and the computed concentration D is stored in the memory.

Figure 12:
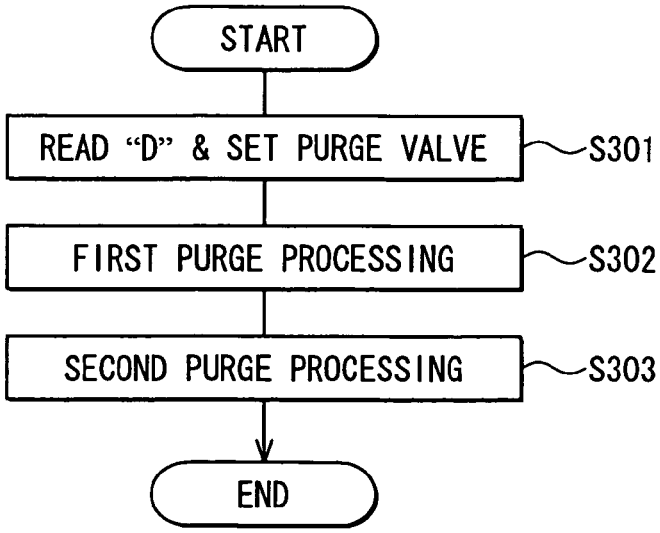
FIG. 12 is a flow chart for describing purge processing in FIG. 3.

Up to this point, the concentration measurement processing has been described. Successively, the flow of purge processing in step S104 will be described on the basis of FIG. 12. Here, when the purge processing is started, the states of the respective valves 18 to 22 are in the states realized in step S204 of the immediately preceding concentration measurement processing.

First, in step S301, the computed concentration D stored in the step S205 of the immediately preceding concentration measurement processing is read from the memory of the ECU 38 to the CPU. Further, in step S301, the opening of the purge controlling valve 18 is set on the basis of the vehicle state quantities such as acceleration position of the vehicle and the computed concentration D, which is read, and then the set value is stored in the memory.

Figure 13:
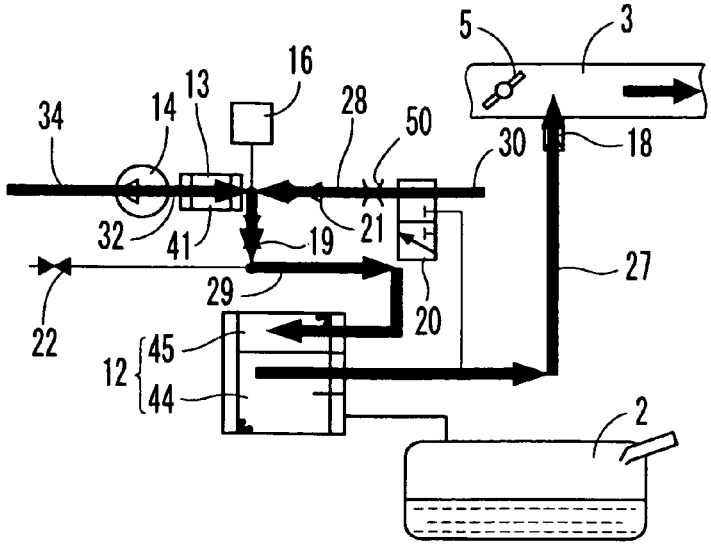
FIG. 13 is a schematic diagram for describing the purge processing in FIG. 3.

Next, in step S302, the ECU 38 brings the purge-controlling valve 18 and the connection controlling valve 19 to an open state and brings the canister-closing valve 22 to a closed state and carries out first purge processing. With this, the valves 18 to 22 are brought into the states shown in FIG. 4 and hence, as shown in FIG. 13, the second detection passage 32 is open to the atmosphere and negative pressure in the intake passage 3 is applied to the elements 27, 12, 29, 28, and 13. Therefore, fuel vapor is desorbed from the main adsorption part 44 and is purged into the intake passage 3. Then, the air-fuel mixture remaining in the first detection passage 28 by the concentration measurement processing flows into the subordinate adsorption part 45 and the fuel vapor in the air-fuel mixture is adsorbed by the subordinate adsorption part 45. Furthermore, because negative pressure is applied to the second canister 13, the fuel vapor is desorbed from the adsorption part 41. Hence, this desorbed fuel vapor also flows into the subordinate adsorption part 45 and is adsorbed there. The first purge processing in step S302 aims to purge the fuel vapor from the second canister 13 in this manner. Then, when it is assumed that the time required to carry out step S203 of the concentration measurement processing is $T_d$, the time required to carry out step S302, that is, the processing time $T_p$ required to carry out the first purge processing is set to $T_p \geqq T_d$. Because the suction pressure of the pump 14 is smaller than negative pressure in the intake passage 3 in steps S201 to S203 of the concentration measurement processing, the fuel vapor can be sufficiently purged from the second canister 13 by setting the processing time $T_p$ in this manner.

In step S302, the set opening stored in the memory in step S301 is read by the CPU and the opening of the purge controlling valve 18 is controlled in such a way as to coincide with the set opening. In this manner, when the time $T_p$ elapses after step S302 is started, the routine proceeds to the next step S303.

Figure 14:
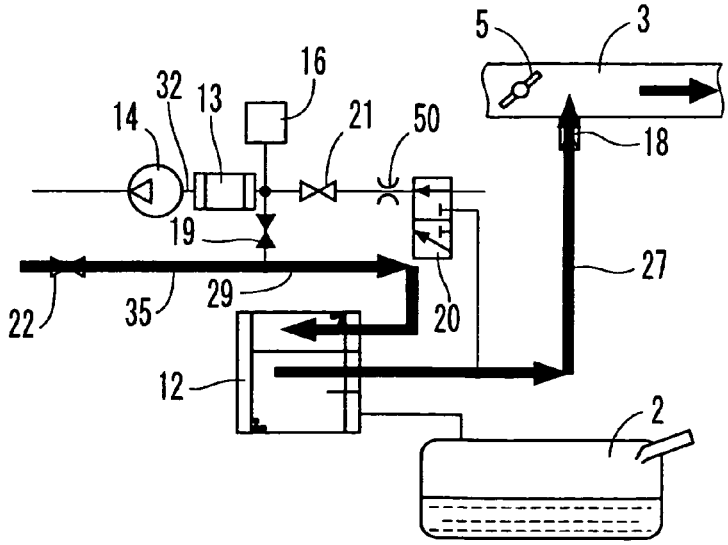
FIG. 14 is a schematic diagram for describing the purge processing in FIG. 3.

In step S303, the ECU 38 brings the connection controlling valve 19 to a closed state and brings the canister closing valve 22 to an open state to carry out second purge processing. With this, the valves 18 to 22 are brought into the states shown in FIG. 4. Hence, as shown in FIG. 14, the third atmosphere passage 35 and the portion 29*b* closer to the subordinate adsorption part 45 of the transit passage 29 are opened to the atmosphere and negative pressure in the intake passage 3 is applied to the elements 27, 12. Hence, fuel vapor is desorbed from the main adsorption part 44 and is purged into the intake passage 3. Here, also in step S303, just as with step S302, the set opening is read and the opening of the purge controlling valve 18 is controlled in such a way as to coincide with the set opening. Moreover, when the purge stop conditions described above are satisfied, step S303 is finished.

Figure 45:
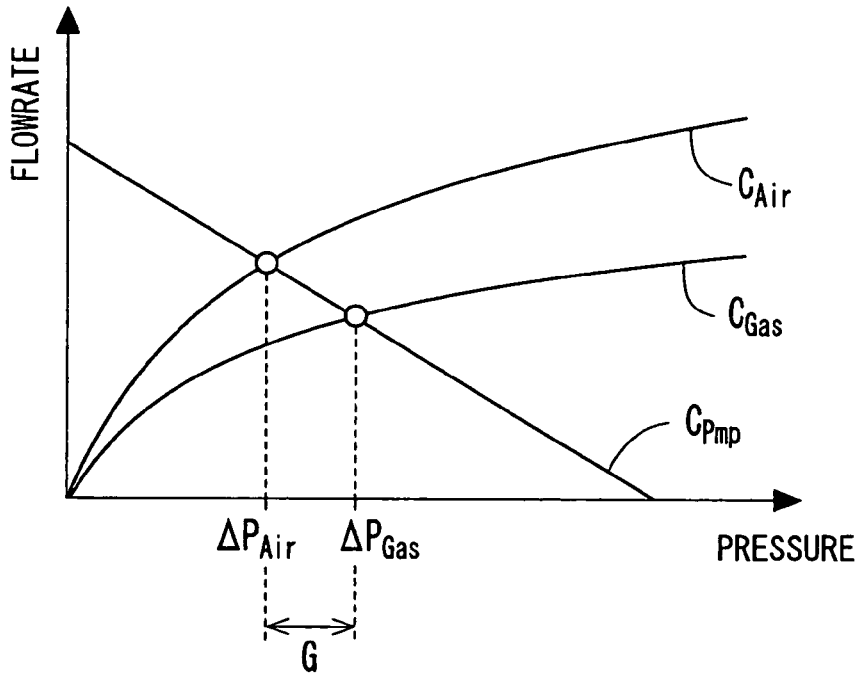
FIG. 45 is a characteristic graph for describing a problem of a comparative example.

According to the first embodiment described above, in the concentration measurement processing, the pump 14 reduces pressure in the second detection passage 32 without desorbing fuel vapor from the second canister 13. With this, in step S201 of the concentration measurement processing, air flowing into the first detection passage 28 and passing through the restrictor 50 passes through the second canister 13 and reaches the pump 14. Hence, as shown in FIG. 2, the pressure difference $\Delta P_{Air}$ becomes a value expressed by an intersection point of the ΔP–Q characteristic curve $C_{Air}$ of air at the restrictor 50 and the P–Q characteristic curve $C_{Pmp}$ of the pump 14. In step S203 of the concentration measurement processing, fuel vapor of the air-fuel mixture flowing into the first detection passage 28 and passing through the restrictor 50 is adsorbed by the second canister 13 and hence only air of the air-fuel mixture reaches the pump 14. Hence, when the pressure difference $\Delta P_{Gas}$ when a 100% concentration air-fuel mixture passes through the restrictor 50 is thought, the pressure difference $\Delta P_{Gas}$ becomes a value equal to the shutoff pressure $P_t$ of the pump 14, as shown in FIG. 2. Hence, the pressure difference $\Delta P_{Gas}$ when the 100% concentration air-fuel mixture passes through the restrictor 50 is larger than that in the case shown in FIG. 45. Accordingly, the difference between the pressure difference $\Delta P_{Gas}$ when the 100% concentration air-fuel mixture passes through the restrictor 50 and the pressure difference $\Delta P_{Air}$ when air passes through the restrictor 50, that is, the detection gain G becomes large. For this reason, in the first embodiment can be secured a detection gain G that is sufficiently large with respect to the pressure resolution capacity of the differential pressure sensor 16. Therefore, it is possible to improve the relative detection accuracy of the pressure difference $\Delta P_{Gas}$ to the pressure difference $\Delta P_{Air}$.

Moreover, according to the first embodiment, in the concentration measurement processing, the fuel vapor is adsorbed by the second canister 13 and does not reach the pump 14. Hence, this can prevent the P–Q characteristics of the pump 14 and by extension the pressure difference detected by the differential pressure sensor 16 from being rendered unstable by the pump 14 sucking the fuel vapor. Further, according to the first embodiment, because the number of revolutions of the pump 14 is controlled to a constant value in the concentration measurement processing, the pressure differences $\Delta P_{Air}$, $\Delta P_{Gas}$ and the shutoff pressure $P_t$ can be detected in a state where the P–Q characteristics of the pump 14 are stable. Therefore, it is possible to reduce such detection errors of the pressure differences $\Delta P_{Air}$, $\Delta P_{Gas}$ and the shutoff pressure $P_t$ that are caused by changes in the P–Q characteristics of the pump 14.

Moreover, according to the first embodiment, the purge controlling valve 18 is closed in step S203 of the concentration measurement processing and hence the air-fuel mixture in the purge passage 27 is surely taken by the first detection passage 28 and the pulsation of negative pressure in the intake passage 3 is not transmitted to the air-fuel mixture flowing into the first detection passage 28. As a result, it is possible to reduce the detection error of the pressure difference $\Delta P_{Gas}$ caused by the deficient flow rate of the air-fuel mixture at the restrictor 50 and the transmission of pulsation of negative pressure.

In this manner, according to the first embodiment, it is possible to detect the pressure differences $\Delta P_{Air}$, $\Delta P_{Gas}$ and the shutoff pressure $P_t$ with accuracy in the concentration measurement processing and hence to improve the computation accuracy of the concentration D of fuel vapor.

Still further, according to the first embodiment, as shown in FIG. 9, the shutoff pressure $P_t$ becomes larger on the negative pressure side than the pressure difference $\Delta P_{Air}$. Hence, according to the concentration measurement processing in which the step S202 where the shutoff pressure $P_t$ is detected is performed successively after the step S201 where the pressure difference $\Delta P_{Air}$ is detected, the total time of the times required to stabilize the pressure difference detected by the differential pressure sensor 16 in the respective steps S202, S201 can be made shorter than the total time in the case where the step S202 is performed before the step S201. Moreover, in step S202 of the concentration measurement processing, the first detection passage 28 is closed between the restrictor 50 and the second canister 13. This can also make it possible to stabilize the pressure difference detected by the differential pressure sensor 16 within a short time. Still further, in the concentration measurement processing, the pressure difference $\Delta P_{Gas}$ is detected in the step S203 after detection of the pressure difference $\Delta P_{Air}$ and the shut off pressure $P_t$. Hence, the air-fuel mixture used for detecting the pressure difference $\Delta P_{Gas}$ does not remain in the first detection passage 28 when the pressure difference $\Delta P_{Air}$ and the shutoff pressure $P_t$ are detected. Therefore, the time required to stabilize the pressure difference detected by the differential pressure sensor 16 when the pressure difference $\Delta P_{Air}$ and the shutoff pressure $P_t$ are detected is not elongated by the air-fuel mixture in the first detection passage 28.

In this manner, according to the first embodiment, the steps S201 and S202 of the concentration measurement processing can be carried out within a short time and hence the total time required to carry out the concentration measurement processing can be shortened. With this, time for carrying out the purge processing is increased and the real quantity of purge can be sufficiently secured. Hence, it is possible to avoid a trouble that the fuel vapor is unexpectedly desorbed from the first canister 12.

In addition, according to the first embodiment, in the first purge processing carried out after the concentration measurement processing, the purge controlling valve 18 and the connection controlling valve 19 are opened and hence negative pressure in the intake passage 3 is applied to the first detection passage 28 and the second canister 13. With this, the air-fuel mixture remaining in the first detection passage 28 and the fuel vapor desorbed from the second canister 13 by the negative pressure are introduced into the subordinate adsorption part 45 of the first canister 12, that is, the air-fuel mixture and the fuel vapor are purged from the first detection passage 28 and the second canister 13. Hence, it is possible to avoid a trouble that the fuel vapor taken by the first detection passage 28 and the second canister 13 in the preceding concentration measurement processing makes an affect on the following concentration measurement processing. Moreover, the fuel vapor adsorbed by the subordinate adsorption part 45 in the first purge processing reaches the main adsorption part 44 after some period of time because of the existence of the space 48. With this, in the first purge processing, the fuel vapor desorbed from the main adsorption part 44 and introduced into the purge passage 27 is not increased. As a result, it is possible to prevent the real concentration of purge from being deviated from the computed concentration D in the immediately preceding concentration measurement processing.

In addition, according to the first embodiment, after the main operation is finished, the connection-controlling valve 19 is normally brought to a closed state. As a result, it is possible to prevent a trouble that the fuel vapor adsorbed by the subordinate adsorption part 45 in the first purge processing is desorbed after the main operation is finished and reaches the first detection passage 28 and the second canister 13 by mistake. Therefore, it is possible to avoid a trouble that the fuel vapor desorbed from the subordinate adsorption part 45 makes an affect on the following concentration measurement processing.

Second Embodiment

Figure 15:
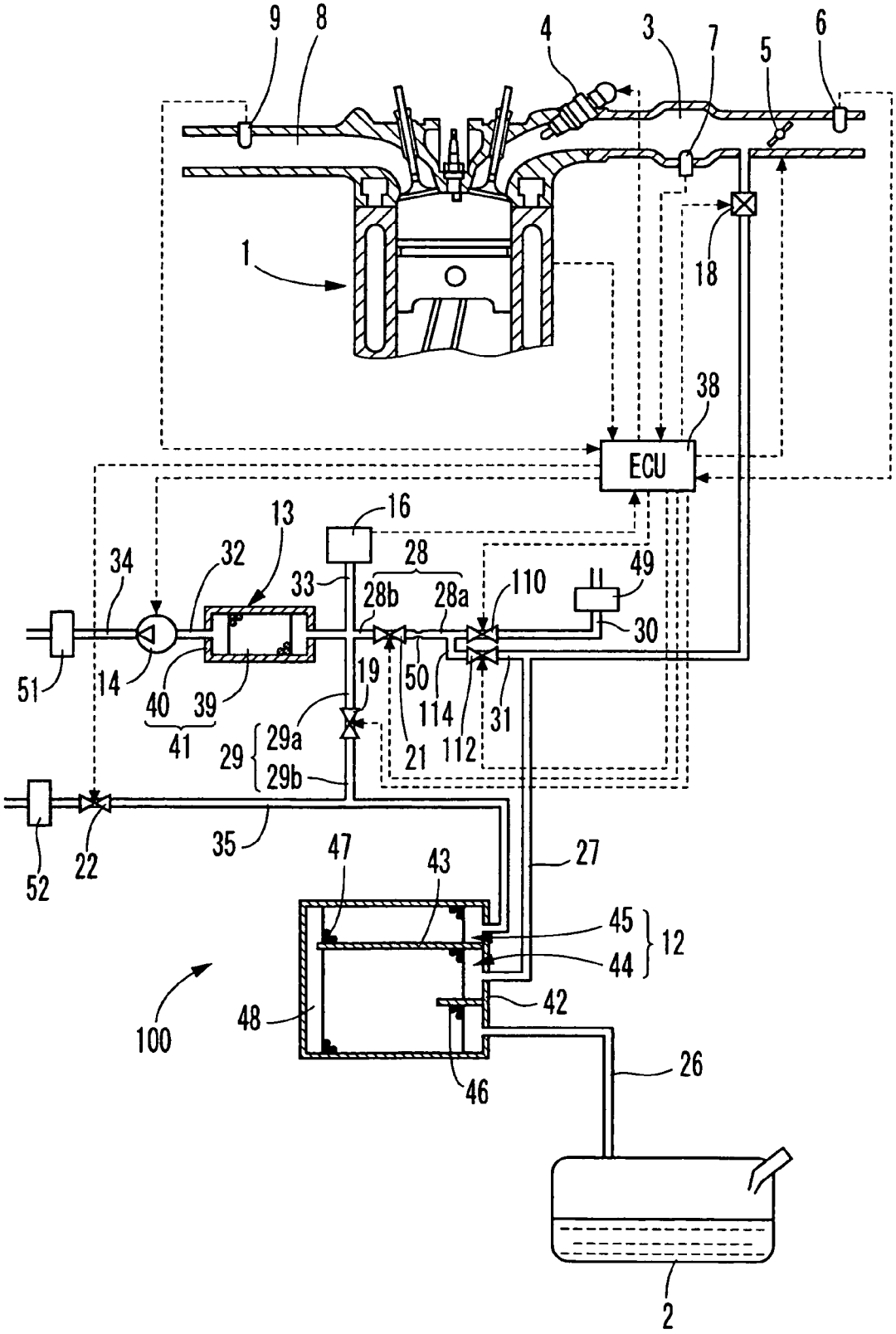
FIG. 15 is a construction diagram showing a fuel vapor treatment apparatus according to a second embodiment.

As shown in FIG. 15, a second embodiment of the present invention is a modification of the first embodiment. The substantially same constituent parts as parts in the first embodiment will be denoted by the same reference symbols and their descriptions will be omitted.

In a fuel vapor treatment apparatus 100 of the second embodiment, in place of the passage changing valve 20 made of a three-way valve, passage connecting valves 110, 112 each made of an electromagnetically driven two-way valve are electrically connected to the ECU 38.

Specifically, the first passage-connecting valve 110 is connected to the first atmosphere passage 30 and an end opposite to the second canister 13 of the first detection passage 28. The first passage connecting valve 110 connected in this manner is opened or closed to control the connection between the first atmosphere passage 30 and the first detection passage 28. Hence, in the state where the first passage-connecting valve 110 is in the open state, air can flow into the first detection passage 28 through the first atmosphere passage 30.

The second passage-connecting valve 112 is connected to the branch passage 31 of the purge passage 27. The second passage connecting valve 112 is connected to the branch passage 114 branched from the first detection passage 28 between the first passage connecting valve 110 and the restrictor 50. The second passage connecting valve 112 connected in this manner is opened and closed to control the connection between the branch passage 31 of the purge passage 27 and the branch passage 114 of the first detection passage 28. Hence, in a state where the second passage-connecting valve 112 is in the open state, the air-fuel mixture in the purge passage 27 can flow into the first detection passage 28 through the branch passages 31,114.

In the second embodiment like this, by changing the states of the respective valves 18, 19, 21, 22, 110, and 112 to the states shown in FIG. 16 in the main operation and the first canister opening operation of the first embodiment, the same operation and effect as in the first embodiment can be produced.

Figure 17:
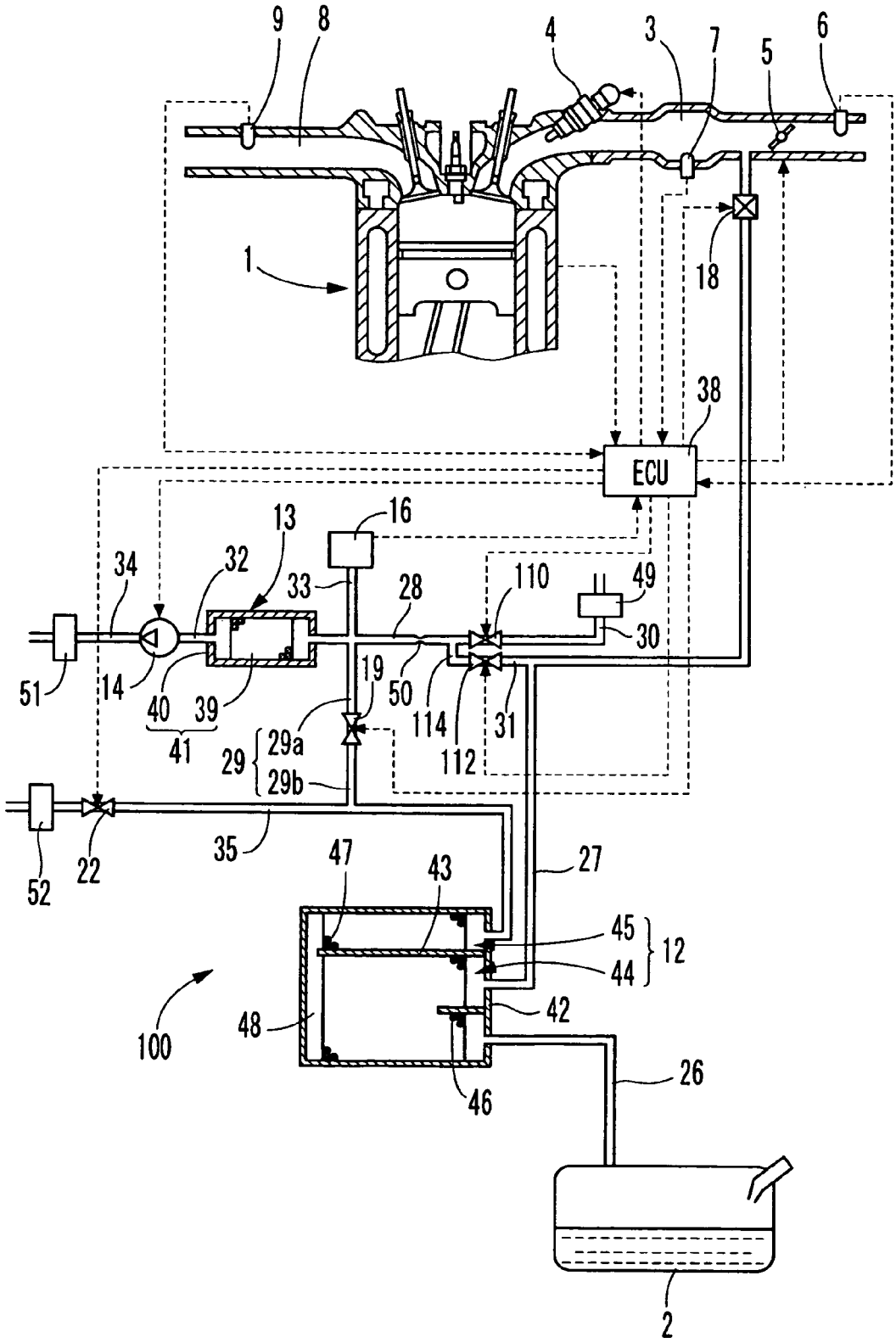
FIG. 17 is a construction diagram showing a fuel vapor treatment apparatus according to a modification of the second embodiment.

Further, providing an additional description of the second embodiment, as shown by a modification in FIG. 17, it is also recommendable not to provide the passage opening/closing valve 21. In this case, by changing the states of the respective valves 18, 19, 22, 110, and 112 to the states shown in FIG. 18 in the main operation and the first canister opening operation, the same operation and effect as in the first embodiment can be produced.

Third Embodiment

Figure 19:
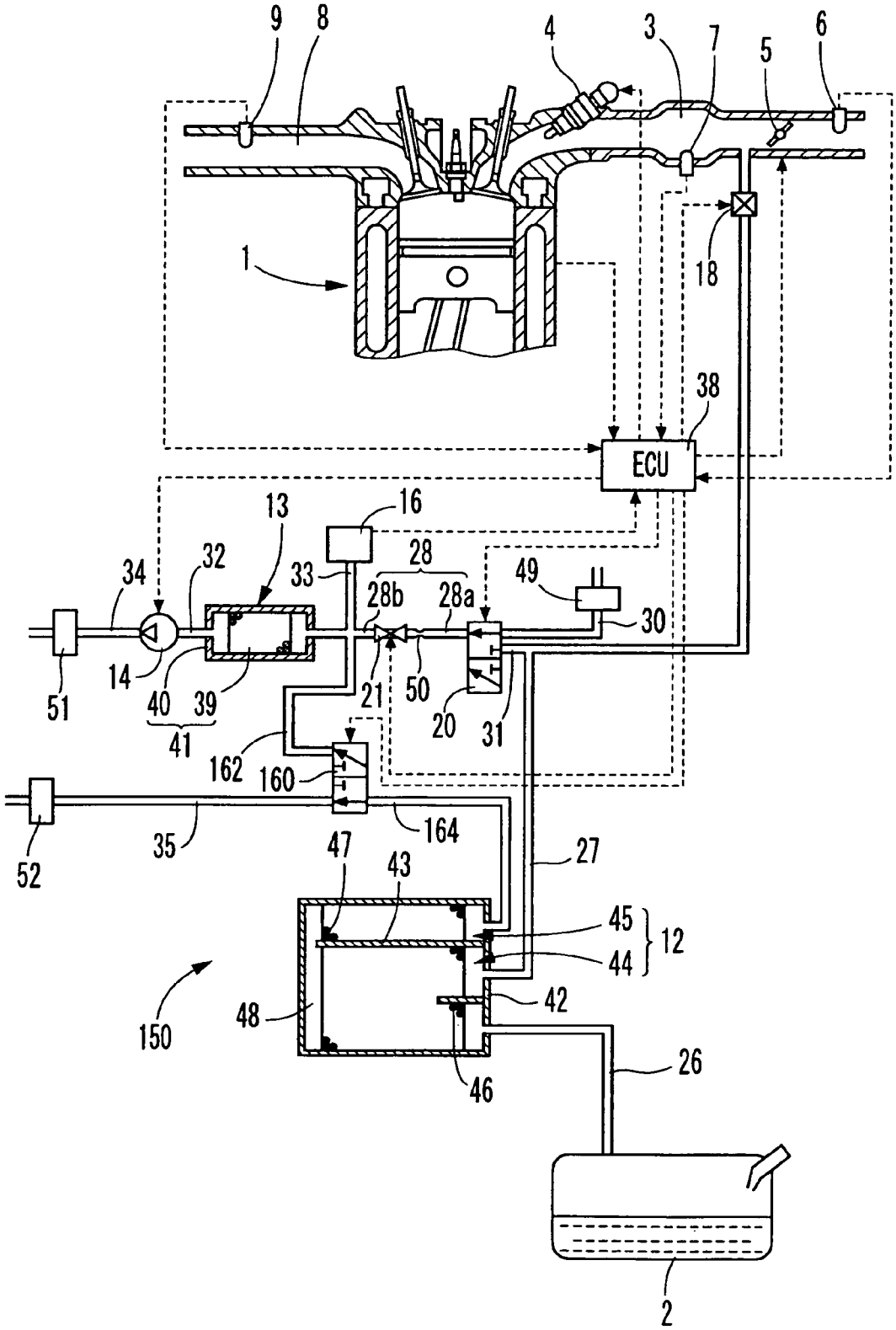
FIG. 19 is a construction diagram showing a fuel vapor treatment apparatus according to a third embodiment.

As shown in FIG. 19, a third embodiment of the present invention is another modification of the first embodiment. The substantially same constituent parts as parts in the first embodiment will be denoted by the same reference symbols and their descriptions will be omitted.

In a fuel vapor treatment apparatuses 150 of the third embodiment, in place of the passage connecting valve 19 and the canister closing valve 22, each of which is made of a two-way valve, a connection changing valve 160 made of an electromagnetically driven three-way valve is electrically connected to the ECU 38.

Specifically, the connection-changing valve 160 is connected to a first transit passage 162 connecting with the first detection passage 28 in place of the transit passage 29 between the passage opening/closing valve 21 (restrictor 50) and the second canister 13. Further, the connection-changing valve 160 is connected to an end opposite to the open end of the third atmosphere passage 35. Still further, the connection-changing valve 160 is connected to a second transit passage 164 connecting with the subordinate adsorption part 45 in place of the transit passage 29. The connection-changing valve 160 connected in this manner changes a passage connecting with the second transit passage 164 between the first transit passage 162 and the third atmosphere passage 35. Therefore, in the first state where the third atmosphere passage 35 connects with the second transit passage 164, the subordinate adsorption part 45 is opened to the atmosphere through these passages 35, 164. Moreover, in the second state where the first transit passage 162 connects with the second transit passage 164, when the purge controlling valve 18 is opened, negative pressure in the intake passage 3 applied to the subordinate adsorption part 45 is applied also to the second transit passage 164, the first transit passage 162, and the first detection passage 28. Therefore, when the negative pressure is applied to the subordinate adsorption part 45 in a state where the air-fuel mixture exists in the first detection passage 28, the air-fuel mixture in the first detection passage 28 flows into the subordinate adsorption part 45 through the first and second transit passages 162, 164.

In the third embodiment like this, by changing the states of the respective valves 18, 20, 21, and 160 to the states shown in FIG. 20 in the main operation and the first canister opening operation, the same operation and effect as in the first embodiment can be produced.

Fourth Embodiment

Figure 21:
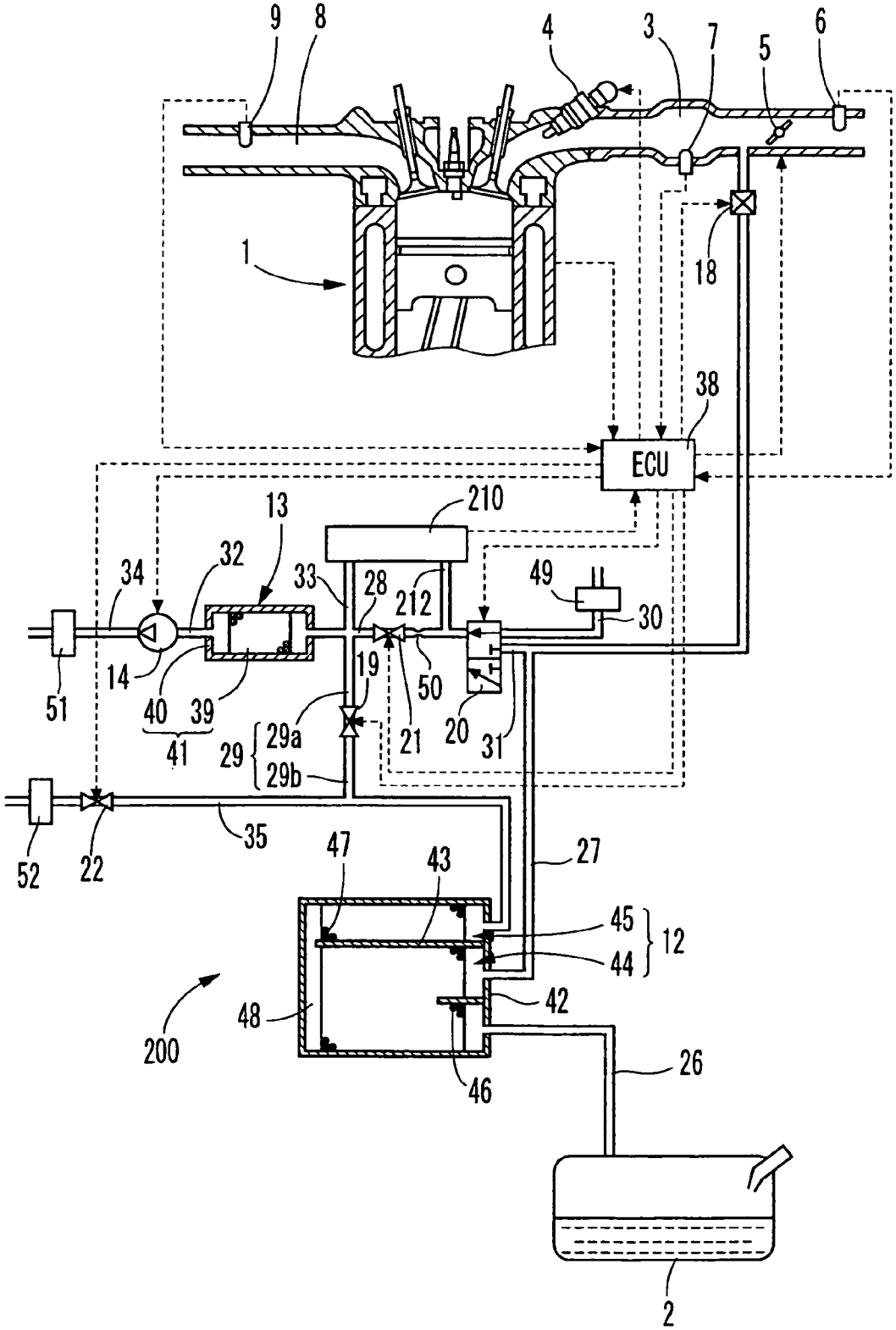
FIG. 21 is a construction diagram showing a fuel vapor treatment apparatus according to a fourth embodiment.

As shown in FIG. 21, a fourth embodiment of the present invention is still another modification of the first embodiment. The substantially same constituent parts as parts in the first embodiment will be denoted by the same reference symbols and their descriptions will be omitted.

In a fuel vapor treatment apparatus 200 of the fourth embodiment, a differential pressure sensor 210 electrically connected to the ECU 38 connects with not only a pressure introducing passage 33 but also a pressure introducing passage 212 branched from the first detection passage 28 between the passage changing valve 20 and the restrictor 50. With this, the differential pressure sensor 210 detects a pressure difference between pressure that it receives from a portion closer to the second canister 13 than the restrictor 50 of the first detection passage 28 through a pressure introducing passage 33 and pressure that it receives from a portion closer to the passage changing valve 20 than the restrictor 50 of the first detection passage 28 through a pressure introducing passage 212. Therefore, a pressure difference that the differential pressure sensor 210 detects when the pump 14 is operated is substantially equal to a pressure difference between both ends of the restrictor 50 in a state where the passage opening/closing valve 21 is in the open state. Moreover, in a state where the passage opening/closing valve 21 is closed and in the first state of the passage opening/closing valve 20, the first detection passage 28 is closed on the suction side of the pump 14 and the pressure introducing passage 212 is brought to the atmospheric pressure, so that the pressure difference that the differential pressure sensor 210 detects when the pump 14 is operated is substantially equal to the shutoff pressure $P_t$ of the pump 14.

According to the forth embodiment like this, the pressure differences $\Delta P_{Air}$, $\Delta P_{Gas}$ and the shutoff pressure $P_t$ can be detected with higher accuracy in the concentration measurement processing and hence the computation accuracy of the concentration D of fuel vapor can be improved.

Fifth Embodiment

Figure 22:
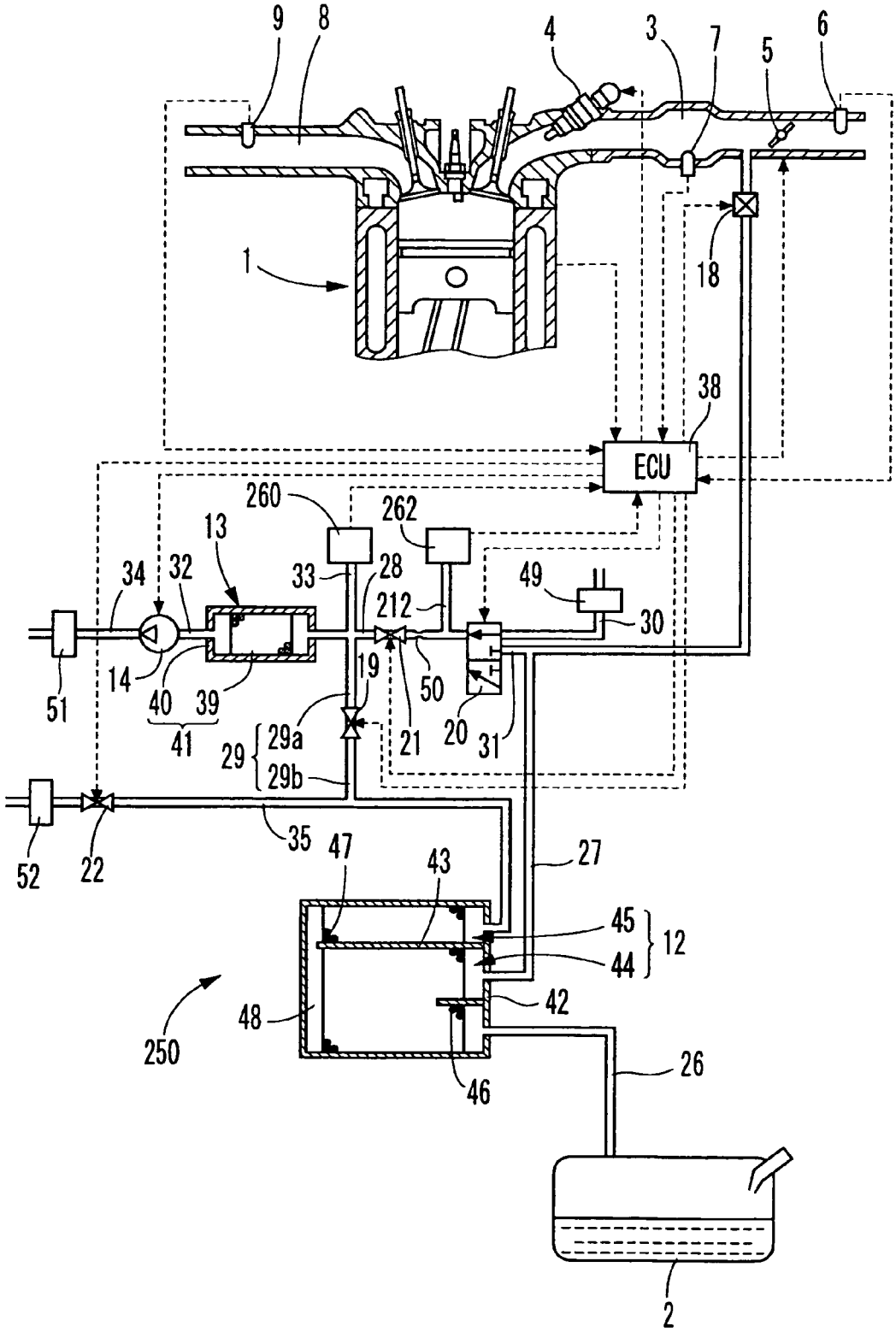
FIG. 22 is a construction diagram showing a fuel vapor treatment apparatus according to a fifth embodiment.

As shown in FIG. 22, a fifth embodiment of the present invention is a modification of the fourth embodiment. The substantially same constituent parts as parts in the fourth embodiment will be denoted by the same reference symbols and their descriptions will be omitted.

In a fuel vapor treatment apparatus 250 of the fifth embodiment, in place of the differential pressure sensor 210, absolute pressure sensors 260, 262 electrically connected to the ECU 38 connect with the pressure introducing passages 33, 212, respectively. With this, the absolute pressure sensor 260 detects pressure that it receives from a portion closer to the second canister 13 than the restrictor 50 of the first detection passage 28 and the absolute pressure sensor 262 detects pressure that it receives from a portion closer to the passage changing valve 20 than the restrictor 50 of the first detection passage 28 through the pressure introducing passage 212. Therefore, the difference value between the pressures detected by the respective absolute pressure sensors 260, 262 when the pump 14 is operated is substantially equal to the pressure difference between both ends of the restrictor 50 in a state where the passage opening/closing valve 21 is in the open state. Moreover, in a state where the passage opening/closing valve 21 is closed and in the first state of the passage changing valve 20, the first detection passage 28 is closed to the pump 14 and the pressure of the pressure introducing passage 212 is brought to the atmospheric pressure, so that the difference value between the pressures detected by the respective absolute pressure sensors 260, 262 when the pump 14 is operated is substantially equal to the shutoff pressure $P_t$ of the pump 14.

In the fifth embodiment like this, in place of monitoring the pressure difference detected by the differential pressure sensor 16 in steps S201 to S203 of the concentration measurement processing, the difference value between the pressures detected by the absolute pressure sensors 260, 262 is monitored. Therefore, according to the fifth embodiment, the pressure differences $\Delta P_{Air}$, $\Delta P_{Gas}$ and the shutoff pressure $P_t$ can be detected with higher accuracy in the concentration measurement processing and hence the computation accuracy of the concentration D of fuel vapor can be improved.

Sixth Embodiment

Figure 23:
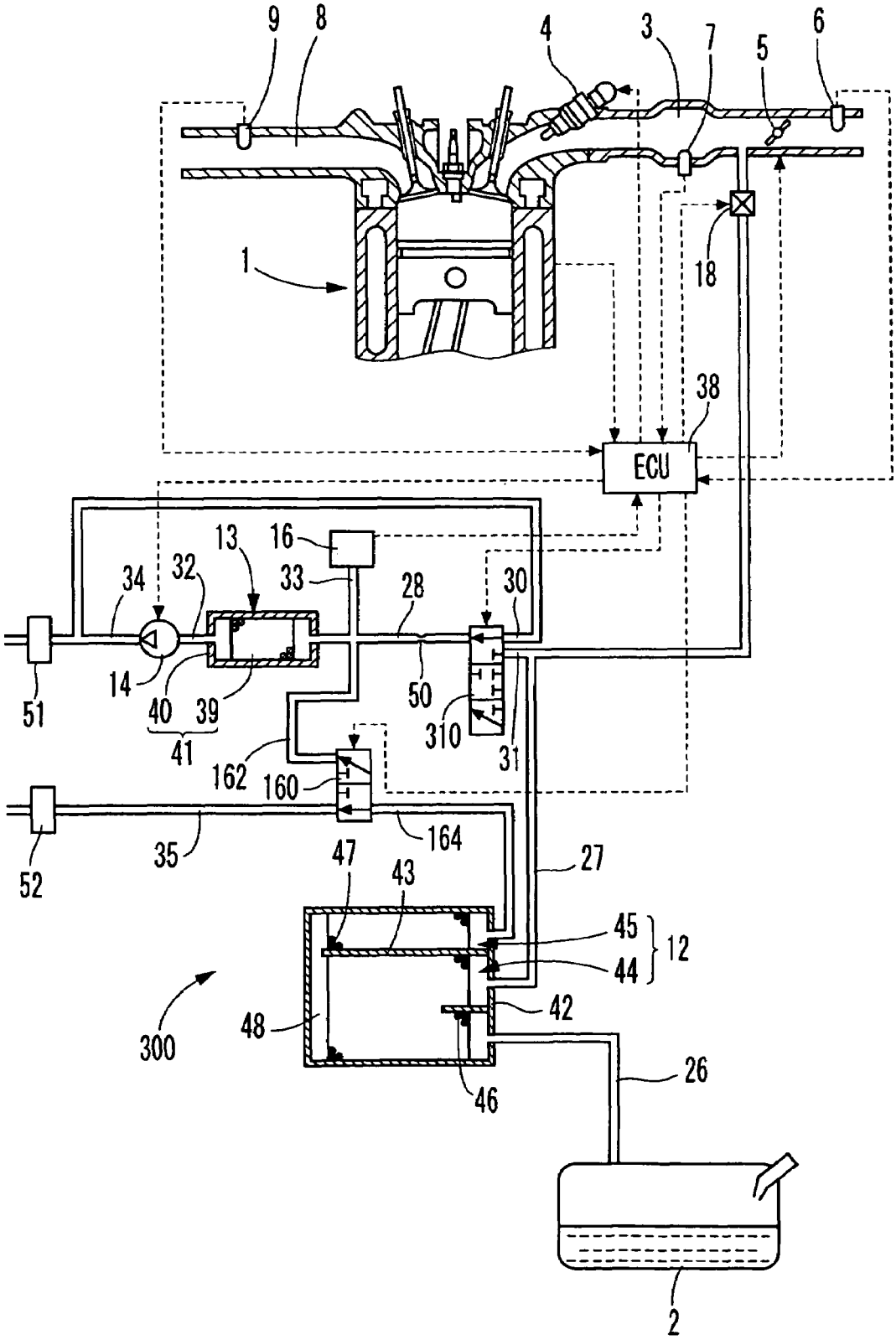
FIG. 23 is a construction diagram showing a fuel vapor treatment apparatus according to a sixth embodiment.

As shown in FIG. 23, a sixth embodiment of the present invention is a modification of the third embodiment. The substantially same constituent parts as parts in the third embodiment will be denoted by the same reference symbols and their descriptions will be omitted.

In a fuel vapor treatment apparatus 300 of the sixth embodiment, in place of the passage changing valve 20 that performs a two-position action and the passage opening/closing valve 21, a passage-changing valve 310 that performs a three-position action is electrically connected to the ECU 38. Specifically, not only the first state where the first atmosphere passage 30 connects with the first detection passage 28 and the second state where the branch passage 31 of the purge passage 27 connects with the first detection passage 28 but also a third state where both of connection between the atmosphere passage 30 and the first detection passage 28 and connection between the branch passage 31 and the first detection passage 28 are interrupted is set in the passage changing valve 310. Therefore, in the first and second states of the passage changing valve 310, the first detection passage 28 is opened at a portion closer to the second canister 13 than the atmosphere passage 30 and the branch passage 31 and in the third state of the passage changing valve 310, the first detection passage 28 is closed at a portion closer to the second canister 13 than the atmosphere passage 30 and the branch passage 31.

In the sixth embodiment like this, by changing the states of the respective valves 18, 160, and 310 to the states shown in FIG. 24 in the main operation and the first canister opening operation, the same operation and effect as described in the first embodiment can be produced. Moreover, in the sixth embodiment, as shown in FIG. 23, the respective open ends of the first and second atmosphere passages 30, 34 are combined into one open end, which results in reducing the number of filters.

Seventh Embodiment

Figure 25:
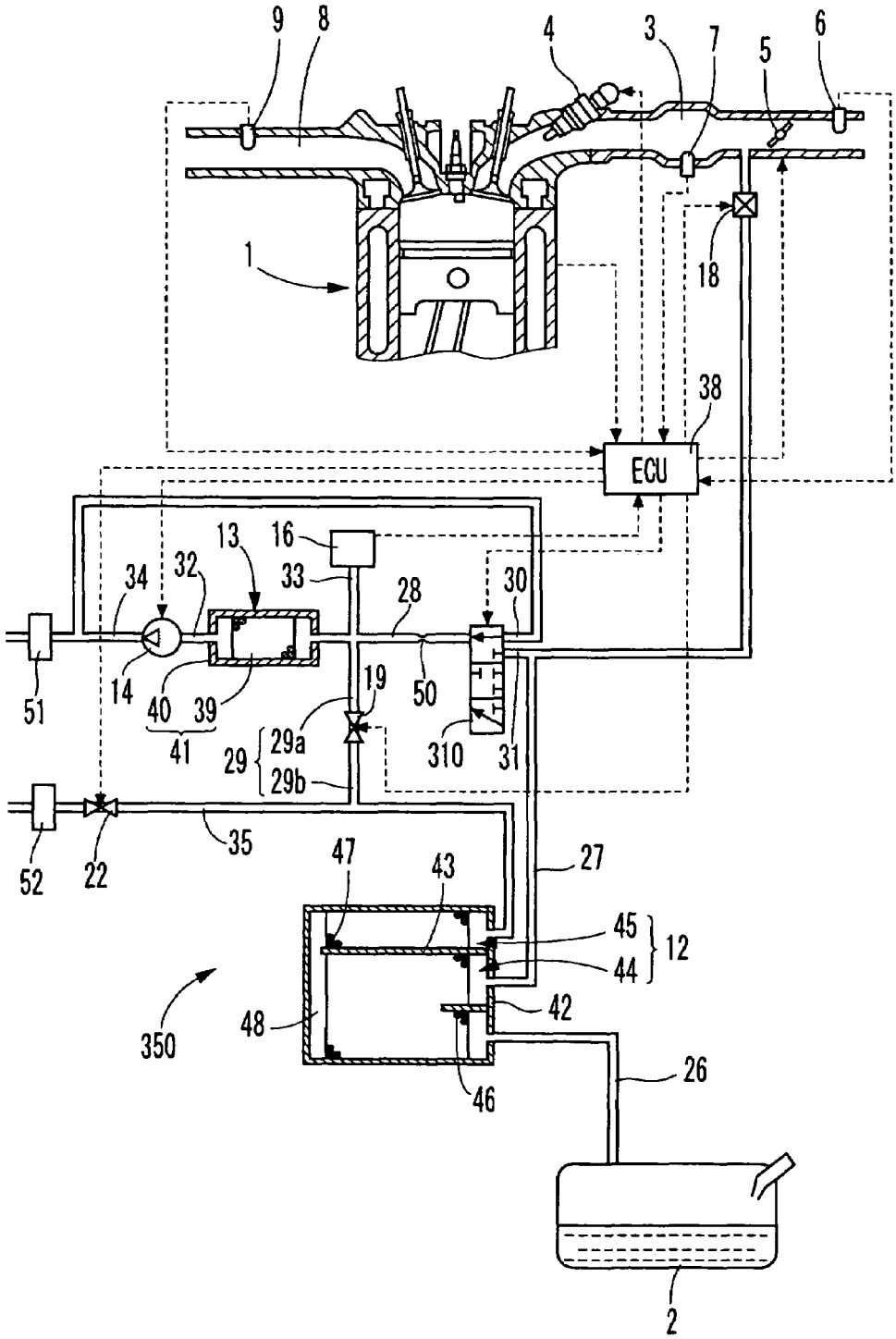
FIG. 25 is a construction diagram showing a fuel vapor treatment apparatus according to a seventh embodiment.

As shown in FIG. 25, a seventh embodiment of the present invention is a modification of the sixth embodiment. The substantially same constituent parts as parts in the sixth embodiment will be denoted by the same reference symbols and their descriptions will be omitted.

A fuel vapor treatment apparatus 350 of the seventh embodiment is provided with the connection controlling valve 19 and the canister-closing valve 22 of the first embodiment in place of the passage-changing valve 160, and is provided with the transit passage 29 of the first embodiment in place of the first and second transit passages 162, 164.

In the seventh embodiment like this, by changing the states of the respective valves 18, 19, 22, and 310 to the states shown in FIG. 26 in the main operation and the first canister opening operation, the same operation and effect as described in the first embodiment can be produced.

Figures 27, 28:
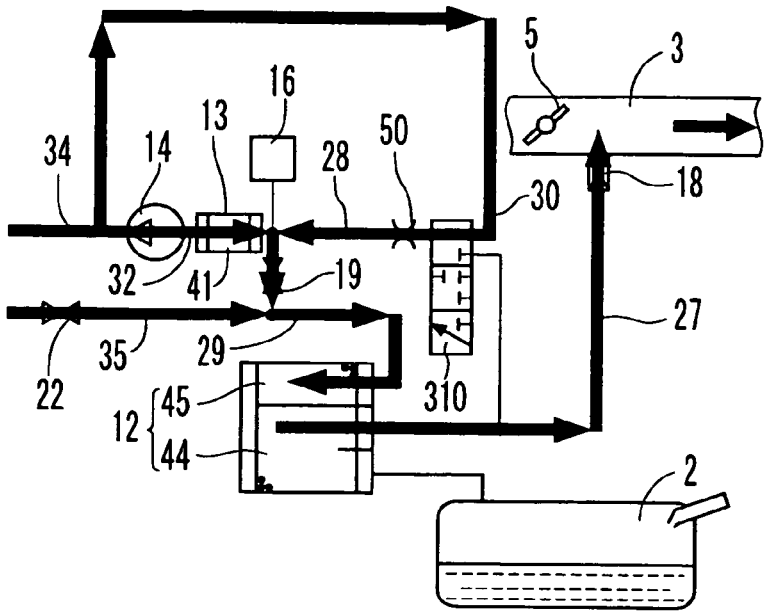
FIG. 27 is a schematic diagram for describing purge processing according to the seventh embodiment.
FIG. 28 is a schematic diagram for describing the main operation and a first canister opening operation of the fuel vapor treatment apparatus according to the eighth embodiment.

Moreover, providing additional descriptions, in the first purge processing in the seventh embodiment, as shown in FIG. 26 and FIG. 27, the canister closing valve 22 is brought to an open state and hence the first canister 12 is opened to the atmosphere through the passages 35, 29. Therefore, the amount of fuel vapor desorbed from the first canister 12 can be increased.

Eighth Embodiment

Figure 29:
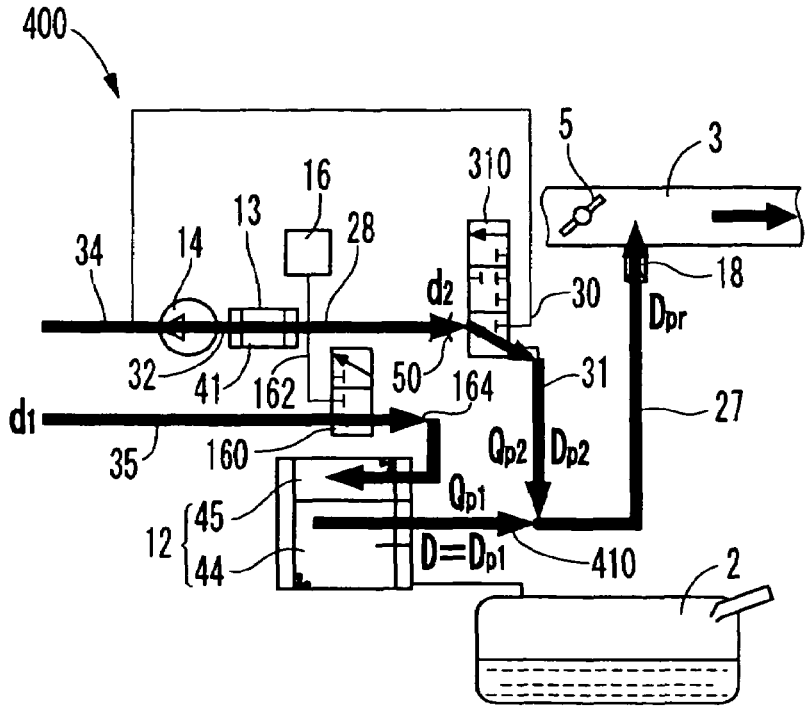
FIG. 29 is a schematic diagram for describing purge processing according to the eighth embodiment.

As shown in FIGS. 28 and 29, an eighth embodiment of the present invention is a modification of the sixth embodiment. The substantially same constituent parts as parts in the sixth embodiment will be denoted by the same reference symbols and their descriptions will be omitted.

In the first purge processing of the sixth embodiment described above, the amount of fuel vapor desorbed from the first canister 12 is decreased by a pressure drop at a portion closer to the end opened to the atmosphere than the first canister 12 and hence it is difficult to secure a sufficient amount of purge within the processing time $T_p$. Moreover, in the first purge processing of the sixth embodiment, there is a possibility that when the negative pressure in the intake passage 3 is eliminated by the ignition switch being turned off in the middle of the processing or the like, a large amount of fuel vapor is desorbed from the subordinate adsorption part 45 of the first canister 12 that gradually adsorbs the fuel vapor desorbed from the second canister 13 and is discharged to the atmosphere. This discharge of the fuel vapor to the atmosphere might occur also in the first purge processing of the seventh embodiment.

Hence, in a fuel vapor treatment apparatus 400 of the eighth embodiment that aims to secure an amount of purge of fuel vapor and to prevent the fuel vapor from being discharged to the atmosphere, as shown in FIG. 28, the connection changing valve 160 is brought not to the second state but to the first state in the first purge processing. As a result, as shown in FIG. 29, the second transit passage 164 is opened to the atmosphere and hence the negative pressure in the intake passage 3 is applied to the first canister 12 through the purge passage 27. At this time, the connection between the first transit passage 162 and the second transit passage 164 is interrupted by the connection changing valve 160 and hence the negative pressure in the intake passage 3 is not applied to the second canister 13 through the first canister 12.

Moreover, in the first purge processing of the fuel vapor treatment apparatus 400, as shown in FIG. 28, the connection changing valve 310 is brought not to the first state but to the second state. As a result, as shown in FIG. 29, the second detection passage 32 is opened to the atmosphere through the pump 14 such as vane pump that might cause internal leak and hence the negative pressure in the intake passage 3 is applied to the second canister 13 through the purge passage 27 and the first detection passage 28.

In this manner, the fuel vapor is surely desorbed from the respective canisters 12, 13 having the negative pressure in the intake passage 3 applied thereto and the desorbed fuel vapors are introduced to the purge passage 27 at the same time and are mixed with each other. Hence, in the first purge processing of the eighth embodiment, the fuel vapor is desorbed from the second canister 13 to recover the adsorption capability of the second canister 13 and, at the same time, the fuel vapor is desorbed from the first canister 12 to realize a large amount of purge of fuel vapor by making effective use of the processing time $T_p$. Further, in the first purge processing of the eighth embodiment, the connection between the passages 162, 164 is interrupted by the connection-changing valve 160 and hence the fuel vapor desorbed from the second canister 13 does not reach the subordinate adsorption part 45 of the first canister 12. Hence, even when the negative pressure in the intake passage 3 is eliminated in the middle of the first purge processing, it is possible to prevent a trouble that a large amount of fuel vapor is discharged from the subordinate adsorption part 45 opened to the atmosphere. Still further, in the first purge processing of the eighth embodiment, the purge passage 27 connects with the first detection passage 28 through the passage changing valve 310 and hence the air-fuel mixture remaining in the first detection passage 28 after the concentration measurement processing is purged to the purge passage 27 by the negative pressure in the intake passage 3. Hence, this purging action can prevent a trouble that the air-fuel mixture remaining in the first detection passage 28 makes an affect on the next concentration measurement processing.

Here, an affect which the action of mixing the fuel vapor desorbed from the second canister 13 with the fuel vapor desorbed from the first canister 12 and purging the mixed fuel vapor makes on a real purge concentration and countermeasures against the affect will be described.

A real purge concentration $D_{pr}$ (%) is expressed by the following equation (25) for obtaining a weighted average of the concentrations of fuel vapors desorbed from the first and second canisters 12, 13 by the flow rates of the fuel vapors. As shown in FIG. 29, $Q_{p1}$ in the equation (25) is the flow rate of gas flowing through the passages 35, 164 and a portion 410 closer to the first canister 12 than a branch point where the purge passage 27 branches from the branch passage 31, and $D_{p1}$ is the concentration of fuel vapor (%) in the portion 410 closer to the first canister 12 of the purge passage 27. Moreover, $Q_{p2}$ is the flow rate of gas flowing through the passages 34, 32, 28, 31 and $D_{p2}$ is the concentration of fuel vapor (%) in the passages 28, 31.

$$D_{pr}=(Q_{p1}\times D_{p1}+Q_{p2}\times D_{p2})/(Q_{p1}+Q_{p2}) \tag{25}$$

Generally, the flow rate of gas is proportional to the area of passage and hence the following equation (26) holds and in this embodiment, as shown in FIG. 29, the concentration of fuel vapor $D_{p1}$ in the portion 410 closer to the first canister 12 of the purge passage 27 is substantially equal to the concentration D computed by the immediately preceding concentration measurement processing. Hence, the real purge concentration $D_{pr}$ is expressed by the following equation (27). As shown in FIG. 29, $d_1$ in the equations (26), (27) is the minimum diameter of the passages 35, 164, and the portion 410 closer to the first canister 12 of the purge passage 27 and $d_2$ is the minimum diameter of the passages 34, 32, 28, 31 and is the diameter of the restrictor 50 in this embodiment.

$$Q_{p1}/Q_{p2}=d_1^2/d_2^2 \tag{26}$$

$$D_{pr}=(d_1^2\times D+d_2^2\times D_{p2})/(d_1^2+d_2^2) \tag{27}$$

An affect made by mixing the fuel vapor desorbed from the second canister 13 with the fuel vapor desorbed from the first canister 12, that is, the deviation of the real purge concentration $D_{pr}$ from the computed concentration D becomes maximum when the concentration of fuel vapor $D_{p2}$ in the passages 28, 31 is 0 (%). Hence, in order to make the deviation of the real purge concentration $D_{pr}$ from the computed concentration D from not larger than L (%), the following equation (28) needs to hold and hence the diameter of opening of the restrictor 50 needs to satisfy the following equation (29).

$$100\times\{D-d_1^2\times D/(d_1^2+d_2^2)\}/D\leqq L \quad (28)$$

$$d_2^2\leqq d_1^2\times L/(100-L) \quad (29)$$

On the basis of these findings, in the eighth embodiment, the apparatus 400 is designed in such a way that the diameter of the opening of the restrictor 50 satisfies the equation (29). With this, the deviation of the real purge concentration $D_{pr}$ from the computed concentration D can be reduced.

Providing an additional description of the eighth embodiment, in the second purge processing after the first purge processing, as shown in FIG. 28, the passage-changing valve 310 is brought to the first state. Hence, the connection between the purge passage 27 and the first detection passage 28 is interrupted and negative pressure in the intake passage 3 is applied only to the first canister 12. Hence, according to the eighth embodiment, the negative pressure in the intake passage 3 is applied to the first canister 12 in both of the first purge processing and the second purge processing. Therefore, the fuel vapor can be sufficiently desorbed even from the first canister 12 that normally adsorbs a larger amount of fuel vapor than the second canister 13, which can realize a large amount of purge of fuel vapor. In addition, because the first purge processing is performed before the second purge processing, even when the negative pressure in the intake passage is eliminated in the middle of the period of purge, the adsorption capability of the second canister 13 is recovered to no small extent. Therefore, it is possible to prevent a trouble that the absorption capability of the second canister is saturated.

Providing a still additional description, although not shown, in the eighth embodiment, the connection changing valve 160 is brought to the second state at the time of checking for leak of the apparatus 400 (the detailed description of which will be omitted here) or the like. However, in the case of construction in which the operation of checking for the leak is not performed, it is also recommended that the connection changing valve 160 and the first transit passage 162 are not provided but that the second transit passage 164 is directly connected to the third atmosphere passage 35. Meanwhile, in the case of construction in which the operation of checking for the leak is performed, it is necessary to satisfy not only the equation (29) but also legal regulations and hence the diameter of the opening of the restrictor 50 is set at a value of, for example, 0.5 mm or less. Therefore, in this case, it is possible to observe the law and at the same time to increase the computation accuracy of the concentration of fuel vapor D.

Ninth Embodiment

Figure 30:
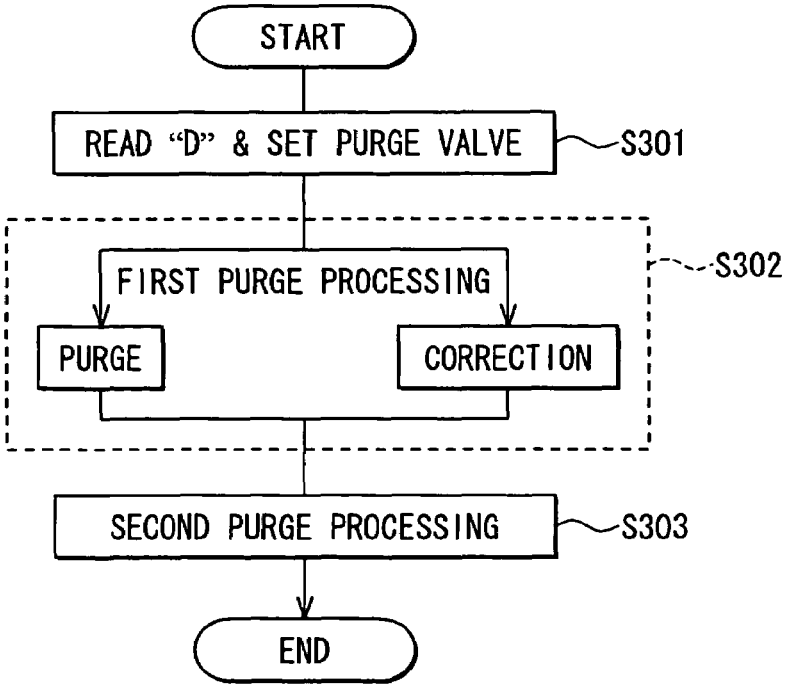
FIG. 30 is a flow chart for describing purge processing according to a ninth embodiment.

As shown in FIG. 30, a ninth embodiment of the present invention is a modification of the eighth embodiment. The substantially same constituent parts as parts in the eighth embodiment will be denoted by the same reference symbols and their descriptions will be omitted.

In the first purge processing of a fuel vapor treatment apparatus 450 (refer to FIGS. 31A and 31B) of the ninth embodiment, just as with the eighth embodiment, the fuel vapors desorbed from the respective canisters 12, 13 are purged to the intake passage 3 and at the same time the computed concentration D by the concentration measurement processing is corrected and its result is reflected on the opening of the purge controlling valve 18. Specifically, in the first purge processing, the ECU 38 corrects the computed concentration D at correction timings $t_c$ that are set one or more within the processing time $T_p$ and acquires the corrected concentration $D_c$ of its result in sequence. Further, every time the ECU 38 acquires the corrected concentration $D_c$, the ECU 38 changes the set opening of the purge-controlling valve 18 on the basis of the acquired concentration $D_c$.

Here, a correction method of the ninth embodiment performed at the correction timings $t_c$ will be described.

Figure 31A:
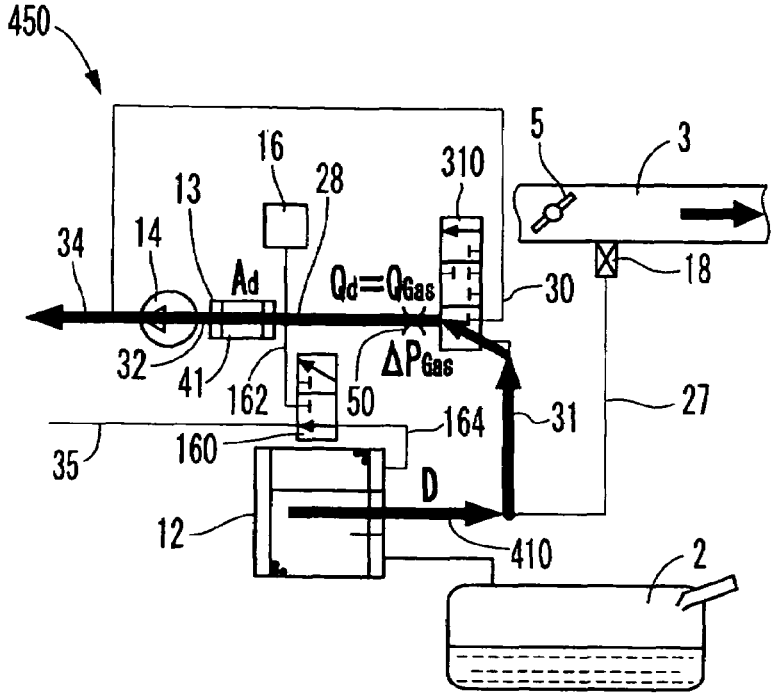
FIGS. 31A and 31B are schematic diagrams for describing a concentration correction in FIG. 30.

First, the amount of fuel vapor $A_d$ adsorbed by the second canister 13 in the concentration measurement processing shown in FIG. 31A is expressed by the following equation (30) using a function $f_1$ of execution time $T_d$ of step S203, the flow rate $Q_d$ of gas flowing through the passages 28, 31 during the execution of step S203, and the computed concentration D.

$$A_d=f_1(T_d, Q_d, D) \quad (30)$$

The time $T_d$ in this embodiment can be thought to be the time required for the second canister 13 to adsorb the fuel vapor. Moreover, the flow rate $Q_d$ of gas in this embodiment coincides with the flow rate of the air-fuel mixture passing through the restrictor 50 as shown in FIG. 31A and hence is expressed by the following equation (31) using a function $f_2$ of the pressure difference $\Delta P_{Gas}$ between both ends of the restrictor 50. Hence, the following function equation (32) can be obtained from the equation (30) and the equation (31).

$$Q_d=Q_{Gas}=f_2(\Delta P_{Gas}) \quad (31)$$

$$A_d=f_3(T_d, \Delta P_{Gas}, D) \quad (32)$$

Figure 31B:
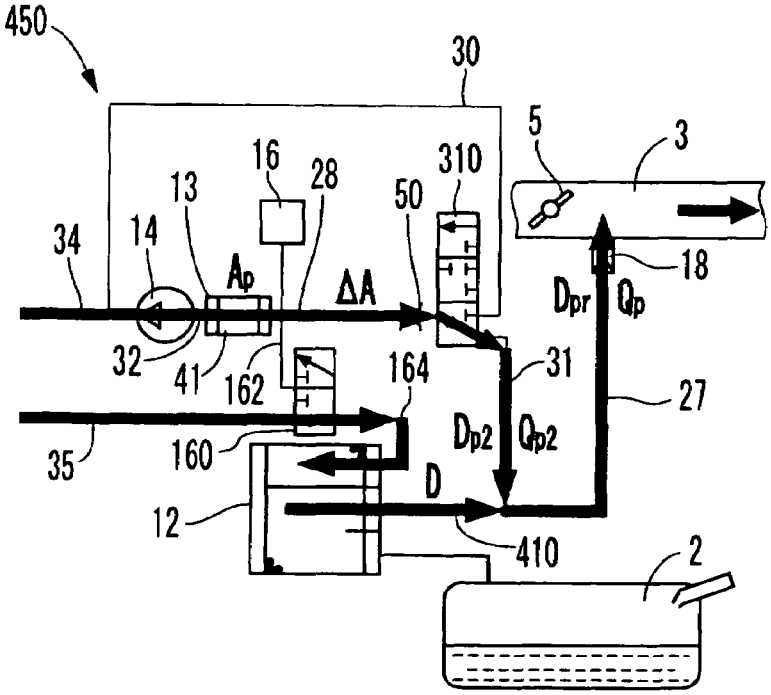

Next, there is a correlation shown in FIG. 32 between the amount of absorption $A_p$ of fuel vapor remaining in the second canister 13 at the correction timing $t_c$ in the first purge processing shown in FIG. 31B and the temporally integrated value $\Sigma Q_{p2}$ of the flow rate $Q_{p2}$ (hereinafter referred to as "the integrated flow rate") of gas passing through the passages 34, 32, 28, 31 within a set period $\Delta T$ from the start of processing to the correction timing $t_c$. Hence, the amount of absorption $A_p$ of fuel vapor remaining in the second canister 13 is expressed by the following equation (33) using a function $f_4$ of the integrated flow rate $\Sigma Q_{p2}$.

$$A_p=f_4(\Sigma Q_{p2}) \quad (33)$$

Figures 32, 34:
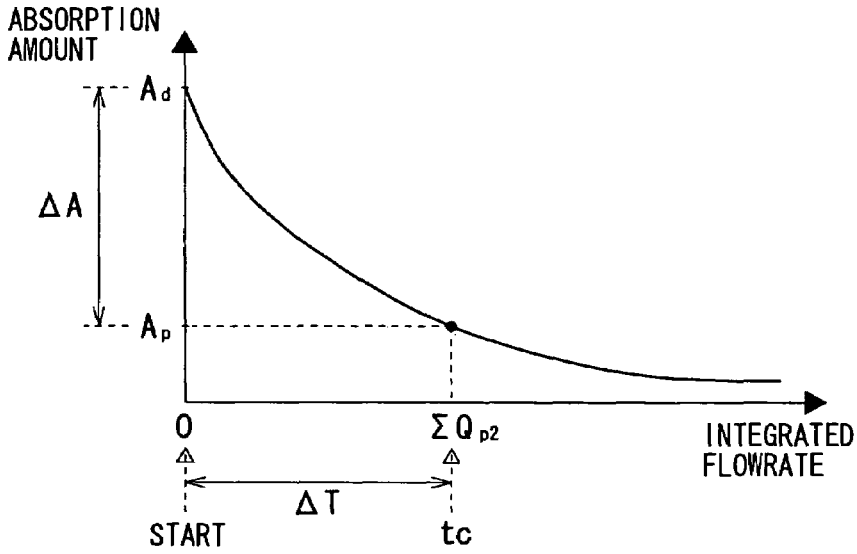
FIG. 32 is a characteristic graph for describing the concentration correction in FIG. 30.
FIG. 34 is a schematic diagram for describing the main operation and a first canister opening operation of the fuel vapor treatment apparatus according to the tenth embodiment.

In this embodiment, the amount of absorption $A_p$ of fuel vapor remaining in the second canister 13 at the timing when the integrated flow rate $\Sigma Q_{p2}$ is 0, that is, when the first purge processing is started, as shown in FIG. 32, is substantially equal to the amount of absorption $A_d$ that is expressed by the equation (32) at the timing when the concentration measurement processing is finished. Hence, the amount of fuel vapor $\Delta A$ desorbed from the second canister 13 in the process of performing the first purge processing is expressed by the following equation (34), as is clear also from FIG. 32. Moreover, in this embodiment, the concentration of fuel vapor $D_{p2}$ in the passages 28, 31 increases or decreases according to the amount of fuel vapor $\Delta A$ (refer to FIG. 31B). Hence, the following function equation (36) can be obtained from the equation (34) and the equation (35).

$$\Delta A = A_d - A_p = f_3(T_d, \Delta P_{Gas}, D) - f_4(\Sigma Q_{p2}) \quad (34)$$

$$D_{p2} = f_5(\Delta A) \quad (35)$$

$$D_{p2} = f_6(T_d, \Delta P_{Gas}, D, \Sigma Q_{p2}) \quad (36)$$

The concentration $D_{p2}$ obtained by the equation (36) has a correlation between the real purge concentration $D_{pr}$ and the computed concentration D, as is clear from the equation (27) described in the eighth embodiment. From this, a function equation for correcting the computed concentration D on the basis of concentration $D_{p2}$ to make the corrected concentration $D_c$ coincide with the real purge concentration $D_{pr}$ is expressed by the following equation (37).

$$D_c = D_{pr} = f_6(D, D_{p2}) \quad (37)$$

On the basis of the above findings, in the ninth embodiment, first, the equation (36) previously stored in the memory of the ECU 38 is read and the concentration $D_{p2}$ of the fuel vapor flowing from the second canister 13 through the passages 28, 31 is computed. At this time, the time $T_d$ previously stored in the memory of the ECU 38 and $\Delta P_{Gas}$, D stored in the memory by the concentration measurement processing just before the purge processing are substituted into the equation (36). The integrated flow rate $\Sigma Q_{p2}$ can be obtained by sequentially estimating the flow rate of purge $Q_p$ of gas flowing from the purge passage 27 into the intake passage 3 from the negative pressure in the intake passage 3 and the opening of the purge controlling valve 18, as shown in FIG. 31 B, and by integrating the flow rate of gas $Q_{p2}$ determined from the estimated flow rate for the set period $\Delta T$ and the obtained value is substituted into the equation (36). The detection result of the suction pressure sensor 7 is used as the negative pressure in the intake passage 3 and an opening set just before the correction timing $t_c$ is used as the opening of the purge controlling valve 18.

Next, in the ninth embodiment, by reading the equation (37) previously stored in the memory of the ECU 38 and by substituting the concentrations D, $D_{p2}$ into the equation (37), the corrected concentration $D_c$ is computed. Hence, the computed corrected concentration $D_c$ becomes a concentration in which a change caused by mixing the fuel vapors desorbed from the respective canisters 12, 13 is cancelled and hence can correctly reflect the real purge concentration $D_{pr}$ in the first purge processing.

Providing an additional description of the ninth embodiment, in place of using the equation (36) in computing the concentration $D_{p2}$, it is also recommendable to use a table in which correlation of the equation (36) is expressed by a map and is previously stored in the ECU 38. Moreover, in place of using the equation (37) in computing the corrected concentration $D_c$, it is also recommendable to use a table in which the correlation of the equation (37) is expressed by a map and is previously stored in the ECU 38. Furthermore, in place of using the equation (36) and the equation (37) in computing the above-mentioned concentrations in accordance with correction, it is also recommendable to use a table in which correlation relating to both of the equations (36), (37) is expressed by a map and is previously stored in the ECU 38.

Providing a further additional description of the ninth embodiment, in the second purge processing of the ninth embodiment, the computed concentration D by the concentration measurement processing just before the purge processing is used as it is in order to set the opening of the purge controlling valve 18.

Tenth Embodiment

Figure 33:
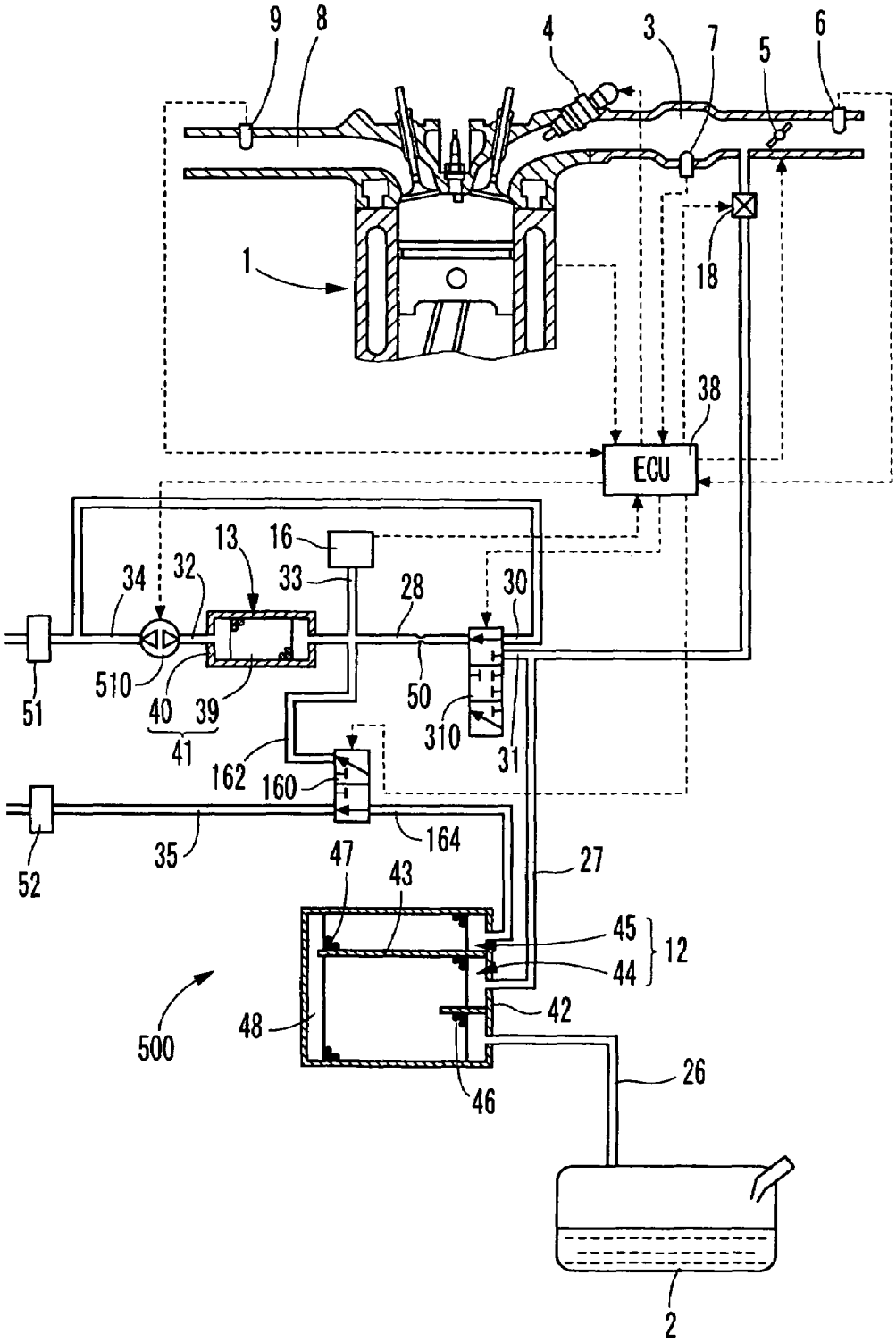
FIG. 33 is a construction diagram showing a fuel vapor treatment apparatus according to a tenth embodiment.

As shown in FIG. 33, a tenth embodiment of the present invention is a modification of the ninth embodiment. The substantially same constituent parts as parts in the ninth embodiment will be denoted by the same reference symbols and their descriptions will be omitted.

A fuel vapor treatment apparatus 500 of the tenth embodiment uses a pump 510 in which the direction of discharge of fluid can be changed. Specifically, the pump 510 is constructed of, for example, an electrically operated vane pump in which a driving motor can be rotated forward or backward and is made to connect with the passages 32, 34 and is electrically connected to the ECU 38. With this, the operating state of the pump 510 is switched to any one of the first state, the second state, and a stop state according to the control of the ECU 38. Here, the pump 510 in the first state increases pressure in the second detection passage 32 to be a discharge side and decreases pressure in the second atmosphere passage 34 to be a suction side. Meanwhile, the pump 510 in the second state decreases pressure in the second detection passage 32 to be a suction side and increases pressure in the second atmosphere passage 34 to be a discharge side.

Figure 35:
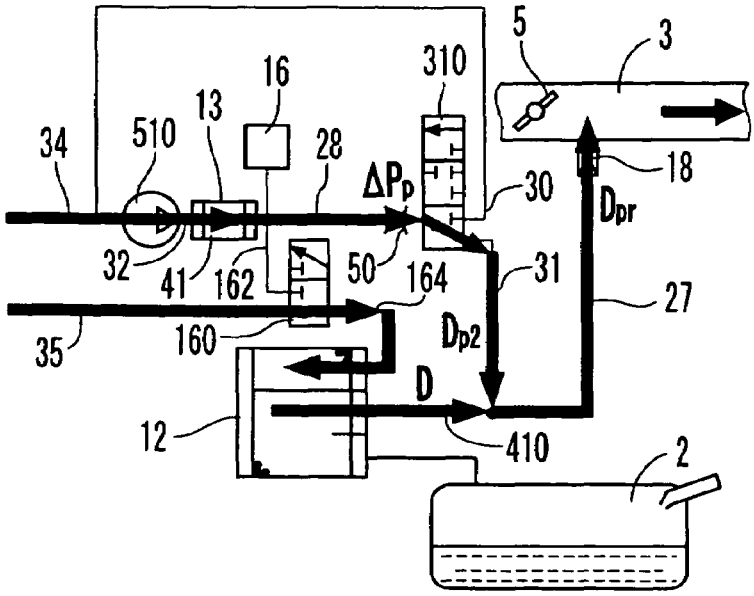
FIG. 35 is a schematic diagram for describing a concentration correction of purge processing according to the tenth embodiment.

In the first purge processing of the tenth embodiment like this, as shown in FIG. 34, the states of the respective valves 18, 160, 310 are controlled and at the same time the pump 510 is brought to the first state to increase pressure in the second detection passage 32 under the operation of controlling the number of revolutions of the pump 510 to a constant value. With this, as shown in FIG. 35, only negative pressure in the intake passage 3 is applied to the first canister 12 to desorb the fuel vapor from the first canister 12. However, not only the negative pressure in the intake passage 3 but also a specified pressure by the pump 510 is applied to the second canister 13 and hence the fuel vapor is desorbed from the second canister 13 with high efficiency and with stability. Hence, according to the tenth embodiment, the time $T_p$ of the first purge processing can be set short and hence by elongating the time of the second purge processing in which only the fuel vapor desorbed from the first canister 12 is purged, the amount of purge can be increased.

Moreover, in the first purge processing of the tenth embodiment, the fuel vapors desorbed from the respective canisters 12, 13 are purged to the intake passage 3 and at the same time the computed concentration D by the concentration measurement processing is corrected for each correction timing $t_c$ and its result is sequentially reflected on the opening of the purge controlling valve 18, and this correction method is different from that in the ninth embodiment.

Hereinafter, the correction method of the tenth embodiment will be described.

Figure 36:
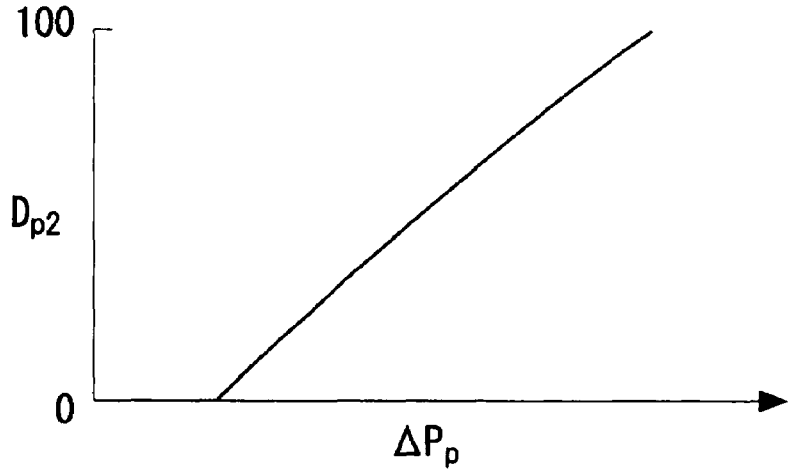
FIG. 36 is a characteristic graph for describing the concentration correction of purge processing according to the tenth embodiment.

In the first purge processing shown in FIG. 35, the concentration $D_{p2}$ of the fuel vapor flowing from the second canister 13 through the passages 28, 31 by the pressuring action of the pump 510, as shown in FIG. 36, correlates to the pressure difference $\Delta P_p$ between both ends of the restrictor 50 at the correction timing $t_c$. Hence, the concentration $D_{p2}$ of the fuel vapor in the passages 28, 31 is expressed by the following equation (38) using a function F of the pressure difference $\Delta P_p$.

$$D_{p2} = F(\Delta P_p) \quad (38)$$

On the basis of these findings, in the tenth embodiment, first, the equation (38) previously stored in the memory of the ECU 38 and the concentration $DP_2$ of the fuel vapor in the passages 28, 31 is computed. At this time, the pressure difference $\Delta P_p$ can be obtained by detecting a stable value by the differential pressure sensor 16 and the obtained value is substituted into the equation (38). Next, in the tenth embodiment, just as with the ninth embodiment, the corrected concentration $D_c$ is computed by using the equation (37). Hence, the corrected concentration $D_c$ on which the real purge concentration $D_{pr}$ in the first purge processing is correctly reflected can be obtained. According to the tenth embodiment in which the pump 510 is controlled to a specified number of revolutions as described above, the detection error of the pressure difference $\Delta P_p$ can be reduced and hence the concentration $D_c$ can be computed with higher accuracy.

Providing an additional description of the tenth embodiment, in place of using the equation (38) in computing the concentration $D_{p2}$, it is also recommendable to use a table in which correlation of the equation (38) is expressed by a map and is previously stored in the ECU 38. Moreover, in place of using the equation (38) and the equation (37) in computing the above-mentioned concentrations in accordance with correction, it is also recommendable to use a table in which correlation relating to both of the equations (36), (37) is expressed by a map and is previously stored in the ECU 38.

Providing a further additional description of the tenth embodiment, in the purge processing, the pump 510 is stopped by the ECU 38 after the time $T_p$ passes from the start of the first purge processing and is held stopped in the second purge processing following the first purge processing, as shown in FIG. 34.

Providing a still further additional description of the tenth embodiment, in steps S201 to S203 of the concentration measurement processing of the tenth embodiment, as shown in FIG. 34, the pump 510 is brought to the second state and pressure in the second detection passage 32 is decreased under the operation of controlling the number of revolution of the pump 510 to a specified value.

Eleventh Embodiment

Figure 37:
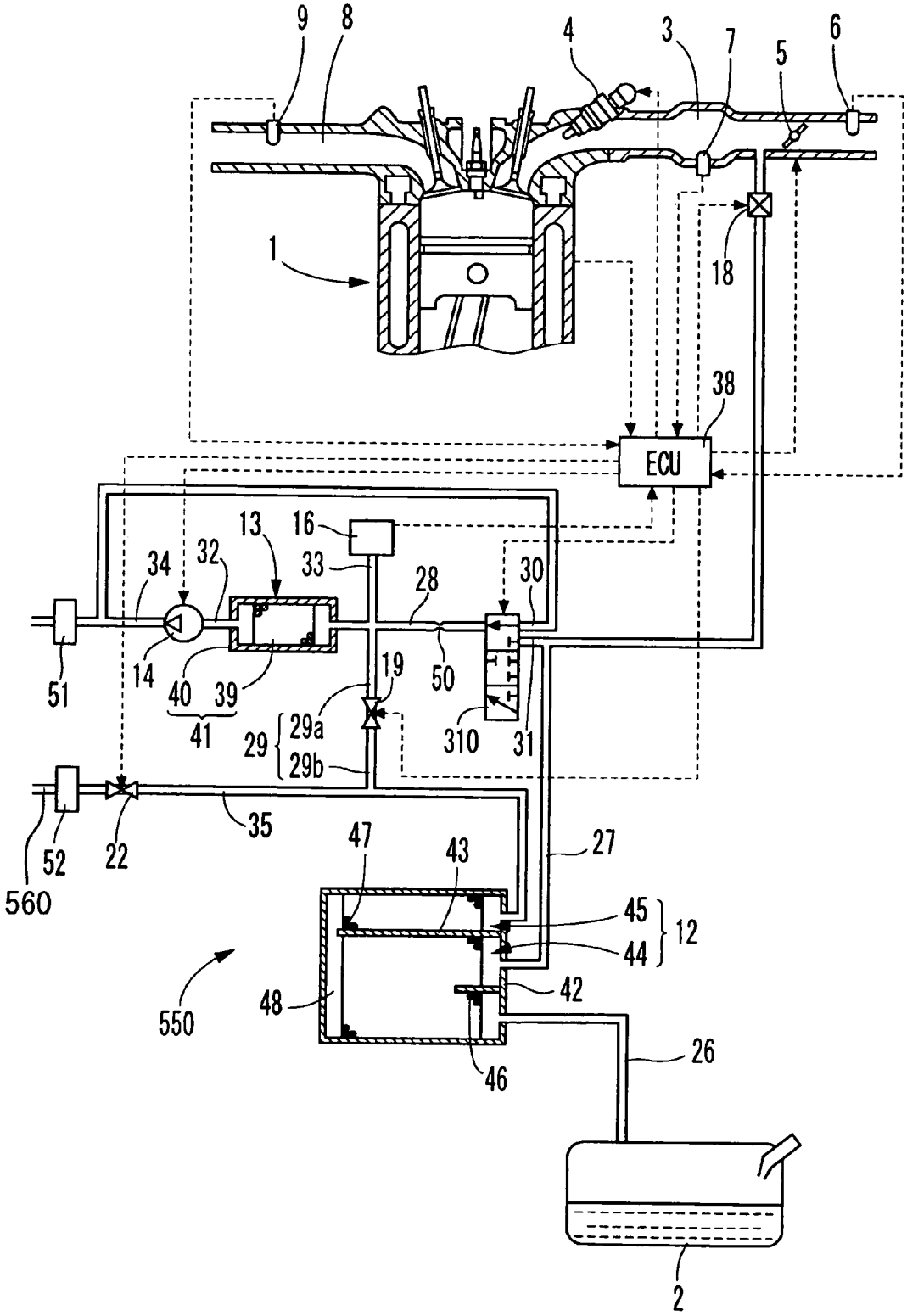
FIG. 37 is a construction diagram showing a fuel vapor treatment apparatus according to an eleventh embodiment.

As shown in FIG. 37, an eleventh embodiment of the present invention is a modification of the eighth embodiment. The substantially same constituent parts as parts in the eighth embodiment will be denoted by the same reference symbols and their descriptions will be omitted.

A fuel vapor treatment apparatus 550 of the eleventh embodiment is provided with the connection-controlling valve 19 and the canister-closing valve 22 of the first embodiment in place of the connection-changing valve 160 and is provided with the transit passage 29 of the first embodiment in place of the first and second transit passages 162, 164.

The eleventh embodiment like this changes the states of the respective valves 18, 19, 22, 310 to the states shown in FIG. 38 in the main operation and the first canister opening operation to produce the same operation and effect as the eighth embodiment.

Providing an additional description of the eleventh embodiment, although not shown in the drawing, the connection controlling valve 19 is brought to an open state and the canister closing valve 22 is brought to a closed state in the operation of checking for leak of the apparatus 550. Hence, in the eleventh embodiment, by the cooperation of the valves 19 and 22, at the time of the main operation and the first canister opening operation, a portion 560 (refer to FIG. 37) closer to an end opened to the atmosphere of the third atmosphere passage 35 connects with a portion 29*b* closer to the subordinate absorption part of the transit passage 29, and at the time of performing the operation of checking for the leak, a portion 29*a* closer to the first detection passage of the transit passage 29 connects with the portion 29*b*. That is, by the cooperation of the valves 19 and 22, a passage connecting with the portion 29*b* of the transit passage 29 is changed between the portion 560 of the third atmosphere passage 35 and the portion 29*a* of the transit passage 29.

Providing a further additional description of the eleventh embodiment, in the first purge processing of the eleventh embodiment, the accurate concentration $D_c$ can be obtained by making a correction in accordance with the ninth embodiment or by making a correction in accordance with the tenth embodiment using the pump 510.

Twelfth Embodiment

Figure 39:
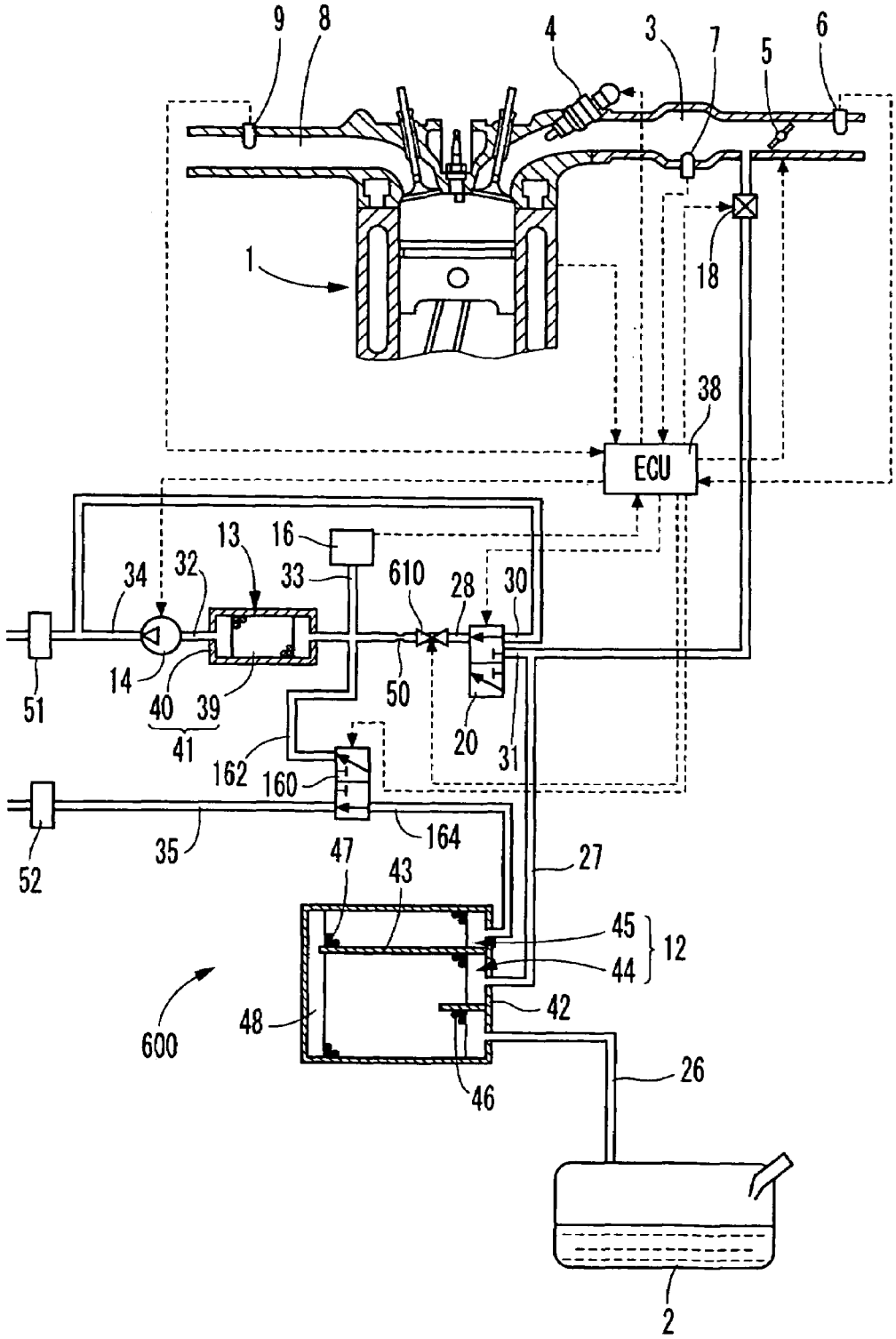
FIG. 39 is a construction diagram showing a fuel vapor treatment apparatus according to a twelfth embodiment.

As shown in FIG. 39, a twelfth embodiment of the present invention is a modification of the eighth embodiment. The substantially same constituent parts as parts in the eighth embodiment will be denoted by the same reference symbols and their descriptions will be omitted.

A fuel vapor treatment apparatus 600 of the twelfth embodiment is provided with the passage changing valve 20 of the first embodiment in place of the passage changing valve 310 and is provided with a passage opening/closing valve 610 of the same construction as the passage opening/closing valve 21 of the first embodiment except for its position in arrangement. Here, the position in arrangement of the passage opening/closing valve 610 is between the restrictor 50 of the first detection passage 28 and the passage-changing valve 20. Hence, the passage opening/closing valve 610 can open and close the first detection passage 28 on a side closer to the second canister 13 than the passages 30, 31, more specifically, on a side opposite to the second canister 13 across the restrictor 50.

The twelfth embodiment like this can produce the same operation and effect as the eighth embodiment by changing the states of the respective valves 18, 20, 160, 610 to the states shown in FIG. 40 in the main operation and the first canister opening operation.

Providing an additional description of the twelfth embodiment, in the first purge processing, an accurate concentration $D_c$ can be obtained by making a correction in accordance with the ninth embodiment or by making a correction in accordance with the tenth embodiment using the pump 510.

Providing a further additional description of the twelfth embodiment, the twelfth embodiment may be provided with the connection controlling valve 19 and is provided with the canister closing valve 22 of the first embodiment in place of the connection changing valve 160 and the transit passage 29 of the first embodiment in place of the first and second transit passages 162, 164.

While a plurality of embodiments of the present invention have been described above, it should not be understood that it is intended to limit the present invention to these embodiments.

Figure 41:
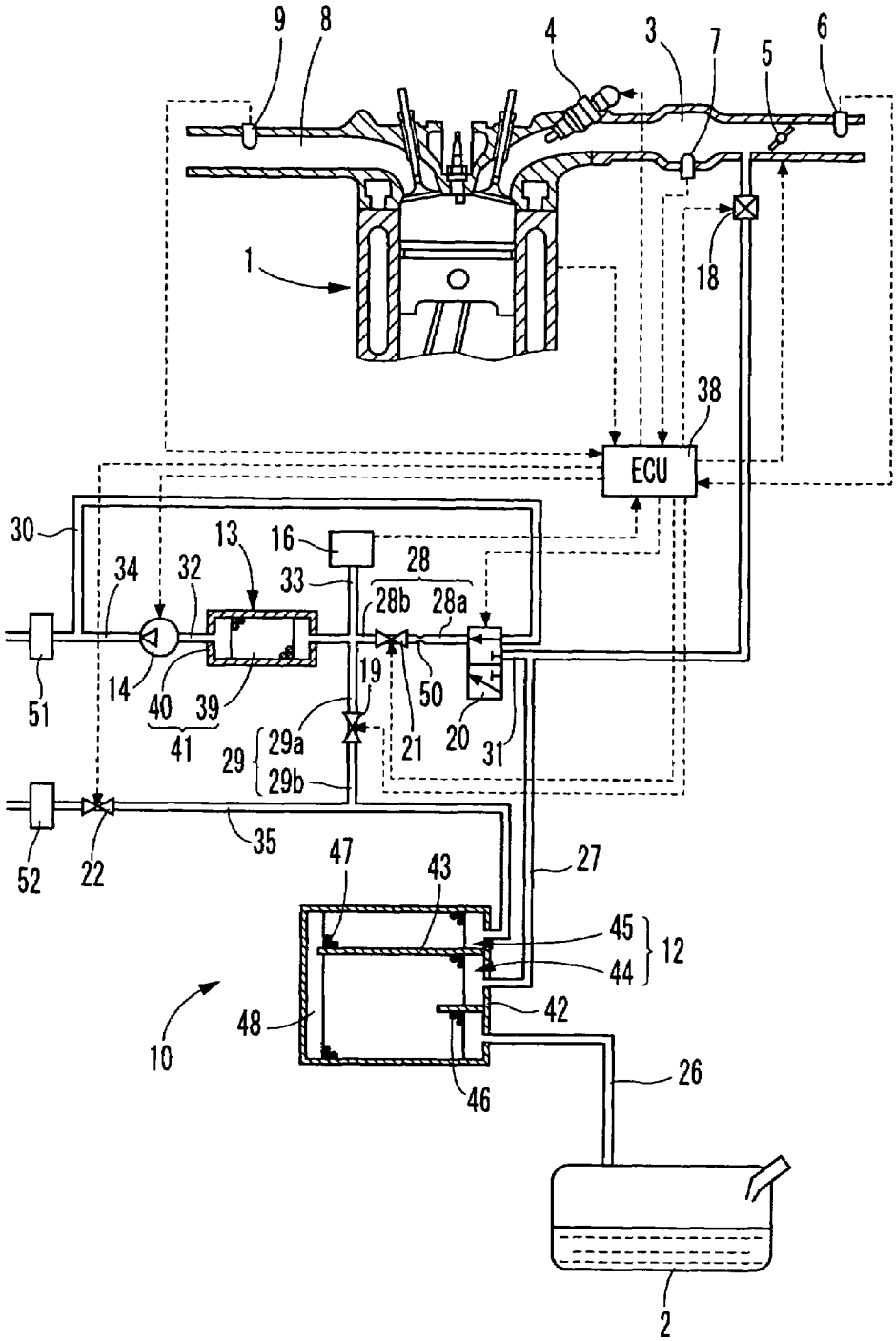
FIG. 41 is a construction diagram showing a fuel vapor treatment apparatus according to a modification of the first embodiment.
Figure 42:
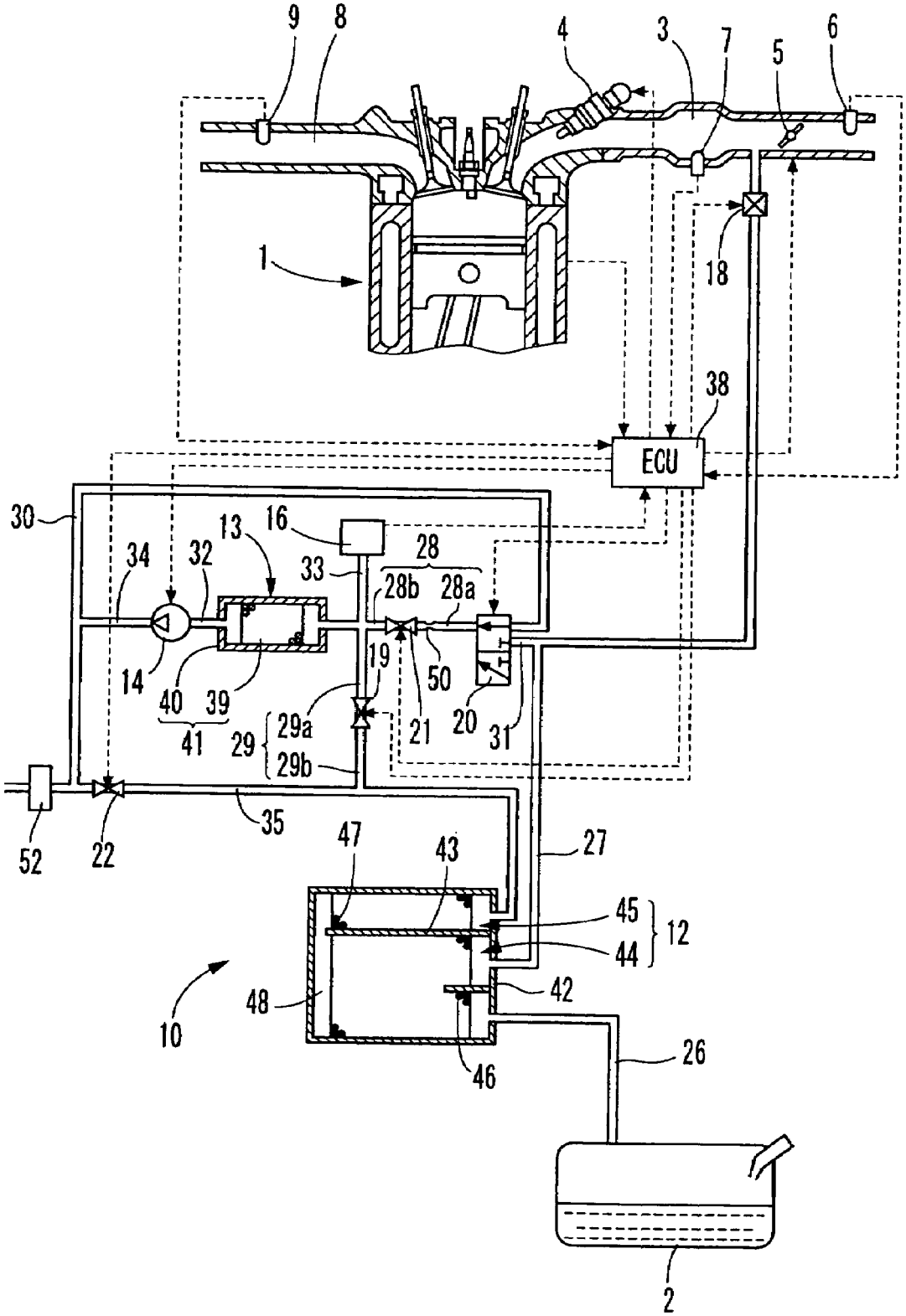
FIG. 42 is a construction diagram showing a fuel vapor treatment apparatus according to another modification of the first embodiment.

For example, in the first to fifth embodiments, it is also recommendable to decrease the number of filters by integrating the respective open ends of the first and second atmosphere passages 30, 34 into one, as shown in FIG. 41 (which shows a modification of the first embodiment). Moreover, in the sixth to twelfth embodiments, in accordance with the first embodiment, the respective open ends of the first and second atmosphere passages 30, 34 may be separated from each other. Furthermore, in the first to twelfth embodiments, in a case where the vapor adsorbing capacity of the canister 12 is sufficiently high, it is also recommendable to further decrease the number of filters by integrating the respective open ends of the first to third atmosphere passages 30, 34, 35 into one, as shown in FIG. 42 (which is a modification of the first embodiment).

Figure 43:
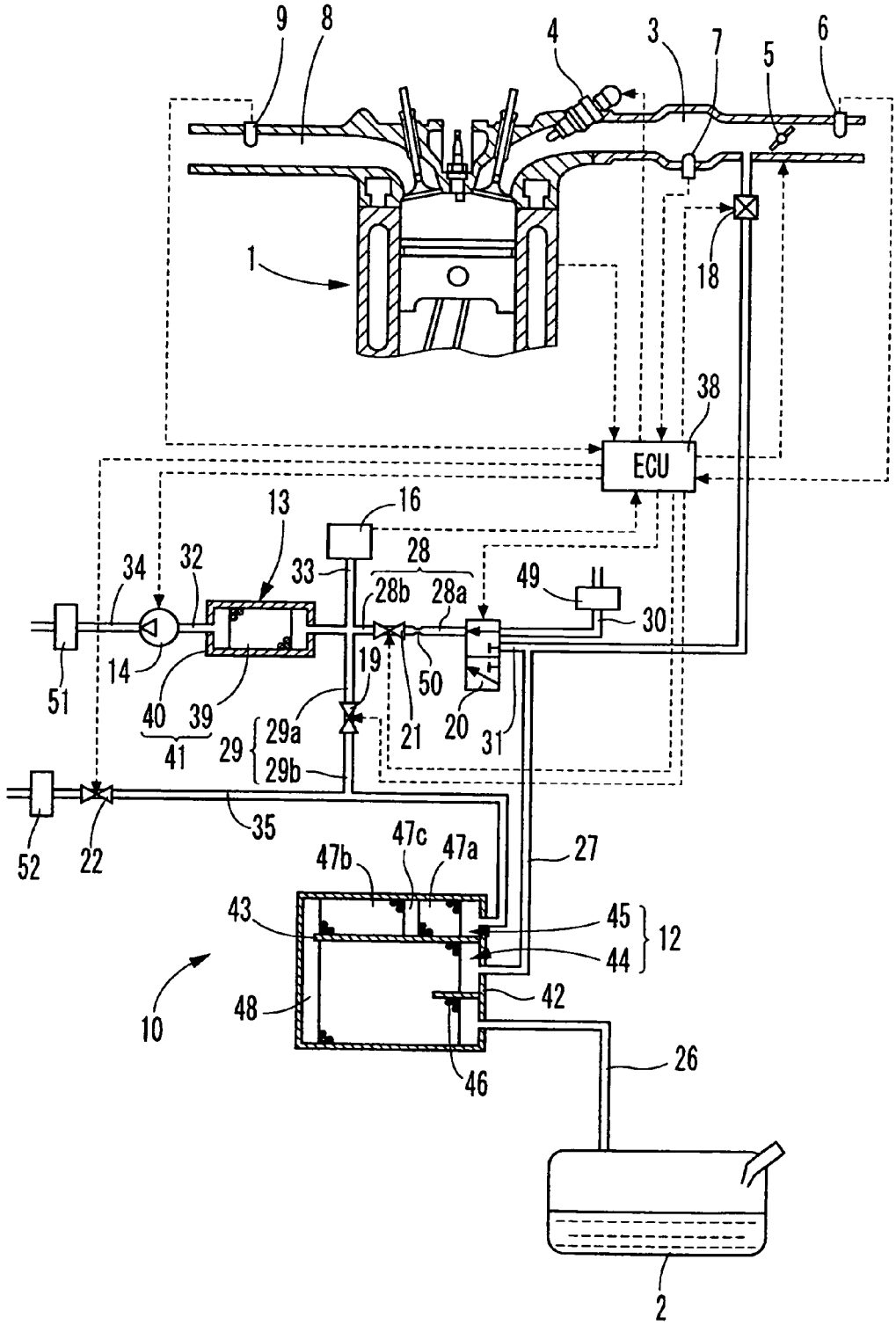
FIG. 43 is a construction diagram showing a fuel vapor treatment apparatus according to still another modification of the first embodiment.
Figure 44:
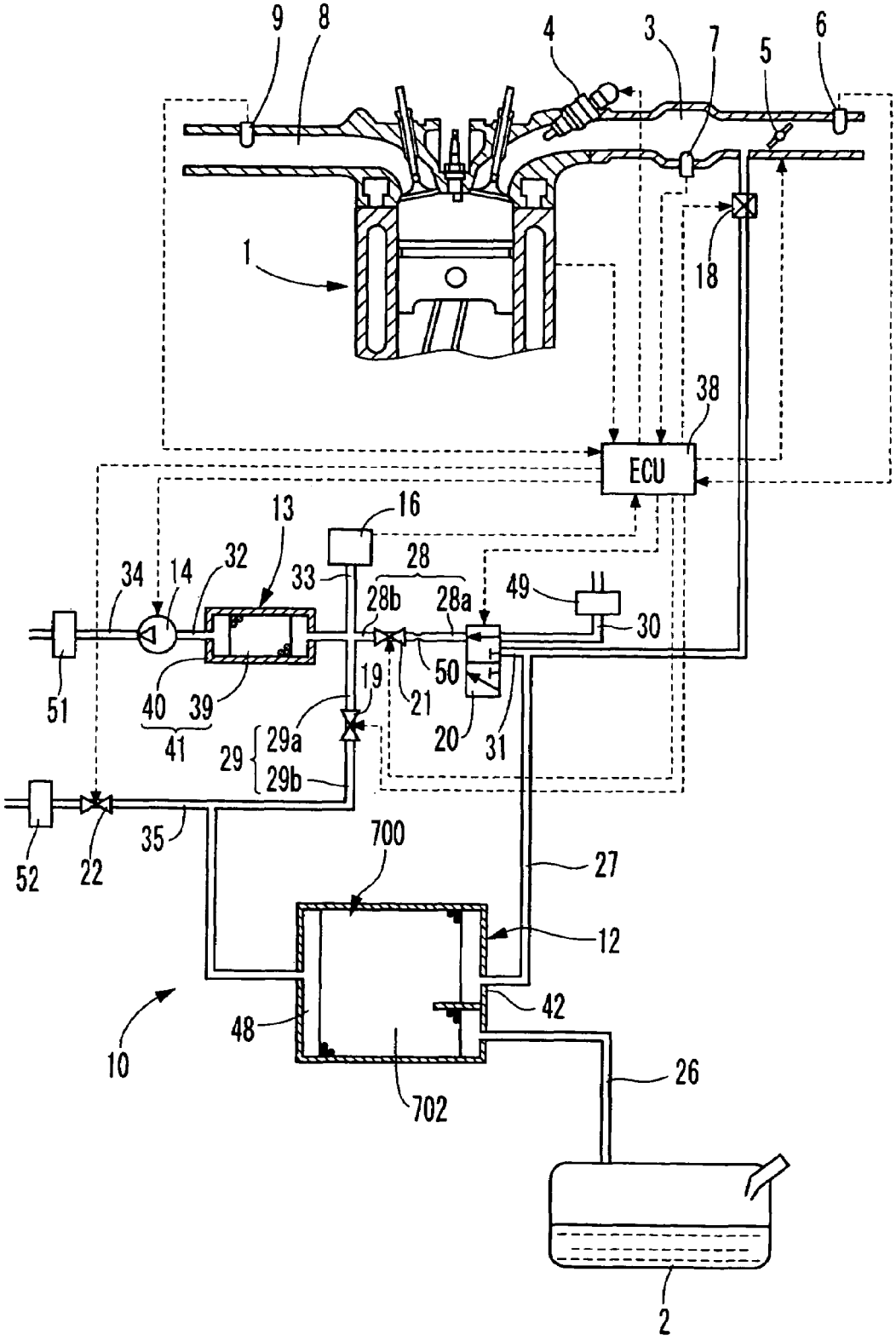
FIG. 44 is a construction diagram showing a fuel vapor treatment apparatus according to still another modification of the first embodiment.

Further, in the first to seventh embodiments, it is also recommendable to divide the adsorptive agent 47 of the subordinate absorption part 45 into a plurality of agents and to form a space 47*c* between the divided adsorptive agents 47*a*, 47*b*, as shown in FIG. 43 (which shows a modification of the first embodiment). In this case, it is possible to increase the time required for fuel vapor, which is contained by the air-fuel mixture flowing from the transit passage 29 or the second transit passage 164 into the subordinate adsorption part 45, to reach the main adsorption part 44. As a result, it is possible to more effectively prevent a real purge concentration from being deviated from the computed concentration D in the first purge processing. Moreover, in the first to twelfth embodiments, as shown in FIG. 44 (which shows a modification of the first embodiment), it is also recommendable to construct the first canister 12 of one adsorption part 700 and to cause the transit passage 29 or the second transit passage 164 connecting with the third atmosphere passage 35 to connect with the side opposite to the introduction passage 26 and the purge passage 27 across the adsorptive agent 702.

Further, in the first to twelfth embodiments, it is also recommendable to carry out the concentration measurement processing by changing step S201 for step S202. Moreover, in the concentration measurement processing of the first to twelfth embodiments, it is also recommendable to perform step S203 before steps S201 and S202 or between the steps. Furthermore, in the first to twelfth embodiments, it is recommendable to the first purge processing and the second purge processing by changing the order of them.

In addition, in the concentration measurement processing of the first to twelfth embodiments, it is not necessary to perform the operation of controlling the number of revolutions of the pump 14 to a specified value. In the eleventh embodiment, in the first purge processing, it is not necessary to perform the operation of controlling the number of revolutions of the pump 14 to a specified value. Furthermore, in the first purge processing of the first to fifth embodiments, it is also recommended that when purging gas from a portion closer to the passage changing valve 20 than a portion connecting with the transit passage 29 or the first transit passage 162 in the first detection passage 28 is finished, the passage opening/closing valve 21 is brought to a closed state to continue purging gas from the second canister 13. Still further, similarly, in the first purge processing in the sixth and seventh embodiments, it is also recommended that when purging gas from a portion closer to the passage changing valve 310 than a portion connecting with the first transit passage 162 or the transit passage 29 in the first detection passage 28 is finished, the passage changing valve 310 is brought to the third state to continue purging gas from the second canister 13.

In addition, in the first purge processing of the first and second embodiments, it is also recommendable to bring the canister-closing valve 22 to an open state in accordance with the seventh embodiment. On the contrary, in the first purge processing of the seventh embodiment, it is also recommendable to bring the canister-closing valve 22 to a closed state in accordance with the first embodiment. Moreover, in the second purge processing of the first to twelfth embodiments, it is also recommendable to bring the connection controlling valve 19 to an open state or the connection changing valve 160 to the second state.

In still more addition, in the third to fifth and twelfth embodiments, it is also recommendable to provide passage connecting valves 110, 112 made of a two-way valve in accordance with the second embodiment in place of the passage changing valve 20 made of a three-way valve. Further, in the fourth and fifth embodiments, it is also recommendable to provide passage changing valve 160 made of a three-way valve in accordance with the third embodiment in place of the passage controlling valve 19 made of a two-way valve and the canister closing valve 22. Still further, in the sixth to twelfth embodiments, it is also recommendable to provide a differential pressure sensor 210 in accordance with the fourth embodiment or absolute pressure sensors 260, 262 in accordance with the fifth embodiment in place of the differential pressure sensor 16.

In still more addition, in the first to third embodiments, in accordance with the twelfth embodiment, it is also recommendable to provide the passage opening/closing valve 610 for opening/closing the first detection passage 28 on a side opposite to the second canister 13 across the restrictor 50 in place of the passage opening/closing valve 21. Moreover, on the contrary, in the twelfth embodiment, in accordance with the first embodiment, it is also recommendable to provide the passage opening/closing valve 21 for opening/closing the first detection passage 28 between the second canister 13 and the restrictor 50 in place of the passage opening/closing valve 610.

What is claimed is:

1. A fuel vapor treatment apparatus comprising:

a first canister for adsorbing fuel vapor produced in a fuel tank in such a way that the fuel vapor can be desorbed;

a purge passage for introducing an air-fuel mixture containing fuel vapor desorbed from the first canister into an intake passage of an internal combustion engine and for purging the fuel vapor;

a detection passage for causing the first canister to connect with atmosphere;

a gas flow producing means arranged in the detection passage and for producing a gas flow;

a second canister interposed between the first canister and the gas flow producing means and for adsorbing fuel vapor in the air-fuel mixture in such a way that the fuel vapor can be desorbed; and a pressure detecting means provided between the first canister and the gas flow producing means and for detecting a pressure when the gas flow producing means produces a gas flow;

wherein flow rate of purge is adjusted on the basis of pressure detected by the pressure detecting means.

2. The fuel vapor treatment apparatus according to claim 1, wherein the detection passage has a restrictor interposed between the first canister and the pressure detecting means.

3. A fuel vapor treatment apparatus comprising:

a first canister for adsorbing fuel vapor produced in a fuel tank in such a way that the fuel vapor can be desorbed;

a purge passage for introducing an air-fuel mixture containing fuel vapor desorbed from the first canister into an intake passage of an internal combustion engine and for purging the fuel vapor;

an atmosphere passage opened to the atmosphere;

a first detection passage having a restrictor therein;

a passage changing means for changing a passage connecting with the first detection passage between the purge passage and the atmosphere passage;

a second canister connecting with the first detection passage on a side opposite to the passage changing means across the restrictor and for adsorbing fuel vapor in the air-fuel mixture flowing from the first detection passage in such a way that the fuel vapor can be desorbed;

a second detection passage connecting with the second canister; and a gas flow producing means connecting with the second detection passage and for producing a gas flow in the second detection passage; and a pressure detecting means for detecting a pressure determined by the restrictor and the gas flow producing means, wherein flow rate of purge is adjusted on the basis of detection result of the pressure detecting means.

4. The fuel vapor treatment apparatus according to claim 3, further comprising:

a first transit passage connecting with the first detection passage between the restrictor and the second canister;

a second transit passage connecting with the first canister; and a connection controlling means for controlling a connection between the first transit passage and the second transit passage, wherein the connection controlling means interrupts connection between the first transit passage and the second transit passage in a period during which the pressure detecting means detects pressure, and causes the first transit passage to connect with the second transit passage after the pressure detecting means detects pressure.

5. The fuel vapor treatment apparatus according to claim 4, wherein the first canister includes a first adsorption part connecting with the second transit passage and for adsorbing fuel vapor flowing from the second transit passage, the first canister includes a second adsorption part connecting with the purge passage and for adsorbing fuel vapor desorbed from the first adsorption part and a fuel vapor produced in the fuel tank, and the first adsorption part is connected with the second adsorption part via a space.

6. The fuel vapor treatment apparatus according to claim 4, further comprising a purge controlling means for controlling connection between the purge passage and the intake passage to control purge of fuel vapor, wherein during a purge period after detection of pressure by the pressure detecting means, the connection controlling means causes the first transit passage to connect with the second transit passage, and the purge controlling means causes the purge passage to connect with the intake passage.

7. The fuel vapor treatment apparatus according to claim 6, wherein during the purge period, the passage changing means causes the atmosphere passage to connect with the first detection passage, and interrupts a connection between the purge passage and the first detection passage.

8. The fuel vapor treatment apparatus according to claim 6, wherein the purge period includes a first purge period in which the connection controlling means causes the first transit passage to connect with the second transit passage, and the purge controlling means causes the purge passage to connect with the intake passage, and the purge period includes a second purge period in which the connection controlling means interrupts a connection between the first transit passage and the second transit passage, and the purge controlling means causes the purge passage to connect with the intake passage.

9. The fuel vapor treatment apparatus according to claim 6, wherein the connection controlling means interrupts a connection between the first transit passage and the second transit passage after the purge period.

10. The fuel vapor treatment apparatus according to claim 3, further comprising a purge controlling means for controlling connection between the purge passage and the intake passage to control a purge of fuel vapor, wherein during a purge period after detection of pressure by the pressure detecting means, the passage changing means causes the purge passage to connect with the first detection passage, and the purge controlling means causes the purge passage to connect with the intake passage.

11. The fuel vapor treatment apparatus according to claim 10, wherein the purge period includes a first purge period in which the passage changing means causes the purge passage to connect with the first detection passage, and the purge controlling means causes the purge passage to connect with the intake passage, and the purge period includes a second purge period in which the passage changing means causes the atmosphere passage to connect with the first detection passage and interrupts a connection between the purge passage and the first detection passage, and the purge controlling means causes the purge passage to connect with the intake passage.

12. The fuel vapor treatment apparatus according to claim 10, further comprising:

a first transit passage connecting with the first detection passage;

a second transit passage connecting with the first canister;

an atmosphere passage opened to the atmosphere; and a connection changing means for changing a passage connecting with the second transit passage between the first transit passage and the atmosphere passage; wherein during the purge period, the connection changing means causes the atmosphere passage to connect with the second transit passage, and interrupts a connection between the first transit passage and the second transit passage.

13. The fuel vapor treatment apparatus according to claim 10, wherein the purge controlling means includes:

a first calculating means for calculating a purge amount which is to be purged into the intake passage based on a detection result detected by the pressure detecting means;

a second calculating means for calculating a flow rate of fuel vapor flowing from the second canister during a purge period; and a correction means for correcting a result calculated by the first calculating means based on a result calculated by the second calculating means.

14. The fuel vapor treatment apparatus according to claim 10, wherein during the purge period, the gas flow producing means pressurizes the second detection passage.

15. The fuel vapor treatment apparatus according to claims 10, wherein the pressure detecting means detects a pressure during a detection period and the purge period, and the purge controlling means corrects a purge control amount based on a detected result by the pressure detecting means during the purge period, the purge control amount being determined based on a detected result by the pressure detecting means during the detection period.

16. The fuel vapor treatment apparatus according to claim 3, further comprising a purge controlling means for controlling connection between the purge passage and the intake passage to control purge of fuel vapor, wherein the purge controlling means interrupts connection between the purge passage and the intake passage during a period in which the passage changing means causes the purge passage to connect with the first detection passage in a period in which the pressure detecting means detects pressure.

17. The fuel vapor treatment apparatus according to claim 1, wherein the gas flow producing means is an electrically operated pump and is provided with a pump controlling means for controlling the number of revolutions of the pump to a constant value during a period in which the pressure detecting means detects pressure.

18. The fuel vapor treatment apparatus according to claim 1, wherein the gas flow producing means is an electrically operated pump and is provided with a pump controlling means for controlling the number of revolutions of the pump to a constant value during a purge.

19. The fuel vapor treatment apparatus according to claim 3, further comprising passage opening/closing means for opening and closing the first detection passage at a portion closer to the second canister than the purge passage and the atmosphere passage, wherein a first pressure detection period, a second pressure detection period, and a shutoff pressure detection period are set as detection periods for the pressure detecting means, in the first pressure detection period, the pressure detecting means detects the pressure as a first pressure in a state where the passage opening/closing means opens the first detection passage and where the passage changing means causes the atmosphere passage to connect with the first detection passage and where the gas flow producing means reduces pressure in the second detection passage, in the second pressure detection period, the pressure detecting means detects the pressure as a second pressure in a state where the passage opening/closing means opens the first detection passage and where the passage changing means causes the purge passage to connect with the first detection passage and where the gas flow producing means reduces pressure in the second detection passage, and in the shutoff pressure detection period, the pressure detecting means detects a shutoff pressure of the gas flow producing means in a state where the passage opening/closing means closes the first detection passage and where the gas flow producing means reduces pressure in the second detection passage, wherein flow rate of purge is adjusted on the basis of the first pressure, the second pressure, and the shutoff pressure.

20. The fuel vapor treatment apparatus according to claim 19, wherein the shutoff pressure detection period is set consecutively after the first pressure detection period.

21. The fuel vapor treatment apparatus according to claim 19, wherein the second pressure detection period is set after the first pressure detection period and the shutoff pressure detection period.

22. The fuel vapor treatment apparatus according to claim 19, wherein the passage opening/closing means opens and closes the first detection passage between the restrictor and the second canister.

23. The fuel vapor treatment apparatus according to claim 1, wherein the pressure detecting means includes a first calculating means for calculating an adsorbed amount by the second canister based on a pressure value and a detection time during the detection period; a second calculating means for calculating an adsorbed amount by the second canister based on a pressure value and a purge time during a purge period; and a correction means for correcting the adsorbed amount by the second canister based on the calculated results by the first calculating means and the second calculating means.

24. The fuel vapor treatment apparatus according to claim 23, further comprising a saturation restricting means for restricting a saturation of the second canister based on an adsorbed amount of fuel vapor by the second canister.

25. The fuel vapor treatment apparatus according to claim 19, comprising fuel vapor state computing means for computing state of fuel vapor in the air-fuel mixture from the first pressure, the second pressure, and the shutoff pressure.

26. The fuel vapor treatment apparatus according to claims 25, wherein the state of fuel vapor is a concentration of fuel vapor.

27. The fuel vapor treatment apparatus according to claim 1, wherein the pressure detecting means is an absolute pressure sensor for detecting an absolute pressure.

28. The fuel vapor treatment apparatus according to claim 3, wherein pressure determined by the restrictor and the gas flow producing means is a differential pressure which is detected between both ends of the restrictor.

29. The fuel vapor treatment apparatus according to claim 3, wherein the pressure detecting means is a differential pressure detecting means for detecting a differential pressure between both ends of the restrictor.

30. The fuel vapor treatment apparatus according to claim 3, further comprising a first transit passage connecting with the detection passage between the gas flow producing means and the restrictor.

31. The fuel vapor treatment apparatus according to claim 1, wherein the pressure detecting means is a relative pressure sensor for detecting a relative pressure.

* * * * *